US007238399B2

(12) United States Patent
Ohya et al.

(10) Patent No.: US 7,238,399 B2
(45) **Date of Patent: *Jul. 3, 2007**

(54) INK JET RECORDING MEDIUM, ITS MANUFACTURING METHOD, INK JET IMAGE FORMING METHOD AND IMAGE FORMED THEREBY

(75) Inventors: Hidenobu Ohya, Tokyo (JP); Shuji Kida, Saitama (JP); Atsushi Tomotake, Tokyo (JP); Shinichi Suzuki, Saitama (JP); Makoto Kaga, Tokyo (JP)

(73) Assignee: Konica Corporation, Tokyo (JP)

( * ) Notice: Subject to any disclaimer, the term of this patent is extended or adjusted under 35 U.S.C. 154(b) by 236 days.

This patent is subject to a terminal disclaimer.

(21) Appl. No.: 10/057,652

(22) Filed: Jan. 25, 2002

(65) Prior Publication Data

US 2003/0008113 A1 Jan. 9, 2003

(30) Foreign Application Priority Data

Feb. 6, 2001 (JP) ..... 2001-029418

(51) Int. Cl.
*B41M 5/50* (2006.01)

(52) U.S. Cl. ..... 428/32.25; 427/152

(58) Field of Classification Search ..... 428/32.25, 428/32.34, 32.24
See application file for complete search history.

(56) References Cited

U.S. PATENT DOCUMENTS

| | | | | |
|---|---|---|---|---|
| 6,347,866 | B1 * | 2/2002 | Sunderrajan et al. | 347/100 |
| 6,485,812 | B1 | 11/2002 | Sekiguchi | |
| 6,635,319 | B1 * | 10/2003 | Sunderrajan et al. | 428/32.15 |
| 6,926,399 | B2 * | 8/2005 | Yoshizawa et al. | 347/102 |
| 2003/0108690 | A1 * | 6/2003 | Sadasivan et al. | 428/32.1 |
| 2004/0081773 | A1 * | 4/2004 | Ishida et al. | 428/32.1 |

FOREIGN PATENT DOCUMENTS

| | | |
|---|---|---|
| DE | 199 52 356 A1 | 5/2000 |
| WO | WO 00/35677 A1 | 6/2000 |

* cited by examiner

*Primary Examiner*—Pamela R. Schwartz
(74) *Attorney, Agent, or Firm*—Frishauf, Holtz, Goodman & Chick, P.C.

(57) ABSTRACT

An ink jet recording medium and its manufacturing method are disclosed, the medium comprising a substrate and provided thereon, plural ink absorption layers including an upper layer containing inorganic pigment and thermoplastic particles, wherein the content by weight of the inorganic pigment is greater than that of the thermoplastic particles.

19 Claims, 1 Drawing Sheet

INK JET RECORDING MEDIUM, ITS MANUFACTURING METHOD, INK JET IMAGE FORMING METHOD AND IMAGE FORMED THEREBY

FIELD OF THE INVENTION

The present invention relates to an ink jet recording medium (hereinafter referred to also as a recording medium), its manufacturing method, an ink jet image recording method employing the ink jet recording medium, and an image formed thereby.

BACKGROUND OF THE INVENTION

In recent years, technical advances for ink jet recording have markedly progressed, and the image quality of ink jet prints has approached that of photographic prints, employing a printer technique, an ink technique and an exclusive recording medium. As the image quality has been improved, image storage stability has been also compared with that of photographic prints. Many dye inks used in ink jet recording are pointed out to have problems in that the formed image lowers its quality because dye movement occurs due to poor water resistance or poor resistance to bleed, or chemical reaction specific to the dye due to poor light fastness or poor resistance to oxidizing gases occurs.

There have been many proposals to improve storage stability of dye ink images. For example, in Japanese Patent Publication No. 2-31673, water resistance, weather resistance, and image glossiness has been improved by recording an image on a recording medium comprising an uppermost layer containing thermoplastic organic polymer particles, and then heating the resulting medium to melt the thermoplastic particles and form a film, whereby a polymer protective layer is formed on the surface.

This technique has been continuously studied and put into practical use, but is still poor in various aspects as compared with the silver halide photographic technique.

Further, as a result of technical progress in recent years, the image quality of ink jet prints prepared by utilizing a dye ink has approached those prepared utilizing silver halide photography, and further, the price of such units has been reduced. As a result, ink jet printing has been increasingly employed.

A first problem is ink absorption. In recent years, image quality of ink jet prints has more and more approached that of silver halide photographic prints by marked technical progress of ink jet printers, the use of smaller-sized ink droplets, a multi-dot technique, light colored inks with a low dye concentration, and the like. Further, printing speed has been increased, the number of ink nozzles has been increased, scanning speed has been increased, and recording heads arranged in a line has predominated. Unless a recording medium has sufficient ink absorption speed or ink absorption capacity under such conditions, color bleed or beading occurs, resulting in lowering of image quality. Color bleed herein referred to is what is generally called color blur. Beading herein referred to is one visually recognized as color unevenness in the form of small circles, which is likely to occur due to the low speed of ink absorption in an ink absorption layer. This phenomenon probably occurs due to poor ink absorption (ink penetration) of an upper ink absorption layer comprised of thermoplastic organic polymer particles.

In contrast, a method is disclosed in Japanese Patent O.P.I. Publication No. 2000-203151 which increases the particle size of thermoplastic organic polymer particles, however, the size increase requires more time to melt the particles by heating to form a film, which is an obstacle to shortening the total processing time, which includes an ink jet recording time shortened due to an increase of recording speed increased by improving the ink jet technique. Further, there is a proposal in Japanese Patent O.P.I. Publication No. 7-237348 which adds silica particles to an uppermost layer comprising thermoplastic organic polymer particles in order to minimize beading. However, in the proposed technique, some of the silica particles are buried in the voids formed among the thermoplastic organic polymer particles, resulting in lowering of ink absorption speed. An attempt to adjust the particle distribution in order to improve the ink absorption has been insufficient, since the silica particles are contained in only a limited amount as an additive. A method is disclosed in Japanese Patent O.P.I. Publication No. 2000-280603 in which (coloration) is improved by adding colloidal silica particles in an amount of at most 30% to an uppermost layer comprising thermoplastic organic polymer particles, but this has not provide the effect of improving the ink absorption property.

A second problem is image storage stability. An ink jet recording medium employing the technique of melting thermoplastic organic polymer particles to form a film provides improved water resistance or bleed out resistance, however, the light fastness is not sufficient as compared with that of silver halide photosensitive materials. A proposal is made which records an image on an ink jet recording medium comprising an uppermost layer containing thermoplastic organic polymer particles employing pigment ink capable of improving image storage stability, particularly, light fastness, but does not simultaneously solve another problem. In the disclosure in Japanese Patent O.P.I. Publication No. 11-157207, ink absorption speed is low, and a drying time of 30 minutes is required after ink jet recording, resulting in overall lowering of total throughput. An uppermost ink absorption layer containing thermoplastic organic polymer particles in an ink jet recording medium is disclosed in Japanese Patent O.P.I. Publication Nos. 11-192775 and 11-208097, but the disclosure does not provide sufficient ink absorption. A method is proposed in Japanese Patent O.P.I. Publication No. 2000-158803 in which the particle size of the thermoplastic organic polymer particles is adjusted to be not less than 1 μm, so that pigment particles in pigment ink do not clog ink paths (voids) of the ink absorption layer and also so that ink absorption is not lowered. The size increase requires much time to melt the thermoplastic organic polymer particles by heating to form a film, resulting in an obstacle to shortening of the total throughput (transporting time). A method is proposed in Japanese Patent O.P.I. Publication No. 2000-203152 in which inorganic pigment particles on the order of μm are added to the layer beneath the layer comprised of thermoplastic organic polymer particles. However, the use of inorganic pigment particles of that size lower image transparency, and does not provide the same quality as silver halide photosensitive materials.

A third problem is the total processing time. The total processing time herein referred to means the time required to record an image on a recording medium, and to melt an upper layer to form a film, including drying time and time necessary to melt the layer to form a film. A method is disclosed in Japanese Patent O.P.I. Publication No. 9-104164 which adds glass fibers with a high aspect ratio to an uppermost layer comprising thermoplastic organic polymer particles, in order to increase heat conductivity and reduce the energy required for film formation. However, the simple addition of the glass fiber cannot provide satisfactory ink absorption speed and therefore, is not suitable for high speed printing, and does not contribute to the desired total throughput time.

The above techniques have other problems as described below.

One problem is poor writability on an image. A recording medium comprising an uppermost layer comprised mainly of thermoplastic organic polymer particles is rather resistant in writability with a ball point pen or an aqueous felt-tip pen. That is, the recording medium has poor ink receptivity and is liable to produce stains when rubbing the surface.

Another problem is poor strength of the image surface. In a recording medium comprising an uppermost layer comprised mainly of thermoplastic organic polymer particles, the formed image is likely to be damaged due to the poor surface strength, and the damage is significant.

Still another problem is poor layer strength of the uppermost layer during a period from the time when forming an image to the time when melting the thermoplastic organic polymer particles of the layer to form a film. The thermoplastic organic polymer particles in the layer melt easily to form a film at a later step, and are not strongly combined with another. Most of such layers comprise aqueous latex as thermoplastic organic polymer particles, and have a structure of comparatively poor water resistance before film formation. Accordingly, a recording medium comprising an uppermost layer comprised mainly of thermoplastic organic polymer particles may produce flaws in the transport step, which results from the transport system in a printer after ink jet recording, or may result in damage by rollers on the surface. This phenomenon markedly occurs when it is used in a high speed printer.

A fourth problem is adhesion of an image. When a recording medium with an image is stored at high temperature (for example, in a warm room or a car in summer), covered with the protective sheet in an album, the polymer film on the image surface may adhere to the protective sheet. As the polymer used for thermoplastic organic polymer particles used in the uppermost layer used is a polymer with a high enough Tg that does not adhere to the sheet at ordinary temperature. However, the apparent Tg of such a polymer may be lowered by the action of a solvent in ink used for ink jet recording or a plasticizer in the protective sheet, and the recorded image may adhere to the protective sheet at high temperature that may be realized under normal environmental conditions.

A structure is disclosed in Japanese Patent O.P.I. Publication No. 7-101142 in which the gloss layer of a recording medium contains latex in a small amount and inorganic pigment, however, in this structure, the shape of the latex particles may vary during calender treatment in the manufacture process of the medium. There is, further, disclosed another structure which employs a complex emulsion containing an acryl resin and colloidal silica. This structure is different from the structure in which inorganic pigment and thermoplastic particles are mixed to form ink absorptive voids, but does not provide sufficient ink absorption resulting from inorganic pigment, nor sufficient gloss resulting from polymer components, nor sufficient image storage stability.

As a method of manufacturing a recording medium comprising an upper layer containing thermoplastic particles, a method is known in which an ink absorption layer with high ink absorption is coated on a substrate, and then a layer containing thermoplastic particles is coated on the resulting ink absorption layer. Although aqueous latex is often used as the thermoplastic particles in view of environmental concern, the aqueous latex ordinarily has a low viscosity, and therefore, has the problem that it is difficult to be coated on a substrate and dried. The viscosity can be increased by the addition of binders to the latex in order to overcome the above problem, but that results in lowering of ink absorption speed.

A recording medium with high gloss and high ink absorption is known which comprises silica particles and a hydrophilic binder. The recording medium is manufactured by simultaneously multi-layer coating method employing the viscosity difference among coating solutions, resulting in cost reduction, and has high gloss and high ink absorption, which is favorably accepted on the market. When a thermoplastic particle-containing layer is coated as an upper layer of the void type silica particle-containing recording medium, a silica particle-containing layer is coated on a substrate, and then a layer containing thermoplastic particles is coated on the resulting silica particle-containing layer, as described above. In this coating method, two coating processes and two drying processes are required, which has disadvantage in cost increase.

SUMMARY OF THE INVENTION

The present invention has been made in view of the above. A first object of the invention is to provide an image with improved storage stability, a recording medium giving such an image, and a recording method giving such an image. A second object of the invention is to provide an image with improved image quality, a recording medium giving such an image, and a recording method giving such an image. A third object of the invention is to provide an image with image quality identical to that of silver halide photographic image, a recording medium giving such an image, and a recording method giving such an image. A fourth object of the invention is to provide an image with image storage stability identical to that of silver halide photographic image, a recording medium giving such an image, and a recording method giving such an image. A fifth object of the invention is to provide an image with image quality identical to that of silver halide photographic image at high speed. A sixth object of the invention is to provide a recording medium, which makes it possible to carry out simultaneous multi-layer coating, and reduces its production cost. A seventh object of the invention is to provide an image in which writability on the image is improved, a recording medium giving such an image, and a recording method giving such an image. An eighth object of the invention is to provide an image whose surface strength is enhanced, a recording medium giving such an image, and a recording method giving such an image. A ninth object of the invention is to provide an image in which flaws are difficult to occur in an ink jet printer, a recording medium giving such an image, and a recording method giving such an image. A tenth object of the invention is to provide an image which when stored in an album, is difficult to be adhered to the protective sheet in the album, a recording medium giving such an image, and a recording method giving such an image.

DETAILED DESCRIPTION OF THE INVENTION

Figure 1:
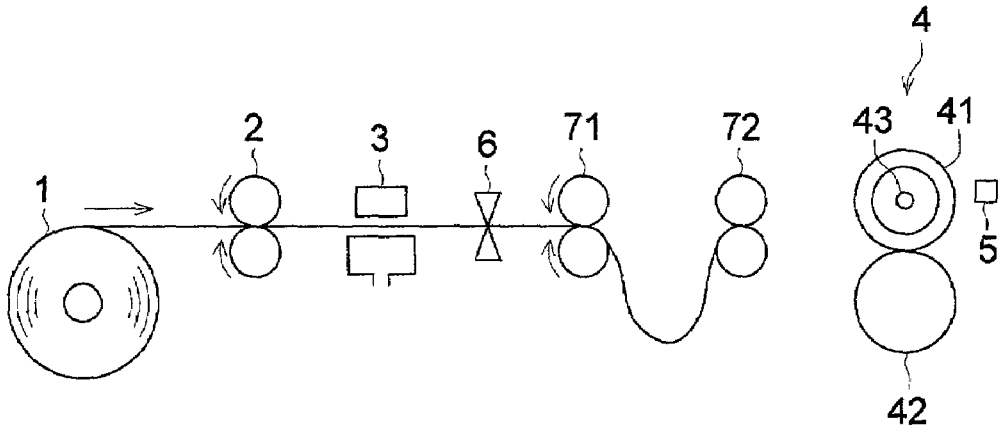
FIG. 1 shows a schematic view of one embodiment of an ink jet recording apparatus employed in the invention.

The above problems have been solved by one of the following constitutions:

1. An ink jet recording medium comprising a substrate and provided thereon, plural ink absorption layers including an upper layer containing inorganic pigment and thermoplastic particles, the content by weight of the inorganic pigment being greater than that of the thermoplastic particles.

2. The ink jet recording medium of item 1, wherein the medium is subjected to image recording employing pigment ink.

3. The ink jet recording medium of item 1, wherein the medium is subjected to image recording and then subjected to heating treatment.

4. The ink jet recording medium of item 1, wherein at least one of the plural ink absorption layers except for the upper layer contains inorganic pigment.

5. The ink jet recording medium of item 1, wherein the inorganic pigment is silica.

6. The ink jet recording medium of item 1, wherein the inorganic pigment is alumina.

7. The ink jet recording medium of item 1, wherein the content ratio by weight of thermoplastic particles/inorganic pigment is from 45/55 to 10/90.

8. The ink jet recording medium of item 1, wherein the solid content of the thermoplastic particles contained in the upper layer is from 0.5 to 15 $g/m^2$ of the medium.

9. The ink jet recording medium of item 1, wherein the solid content of the upper layer is from 2 to 50 $g/m^2$ of the medium.

10. The ink jet recording medium of item 1, wherein the upper layer is an uppermost layer.

11. The ink jet recording medium of item 4, wherein the inorganic pigment is silica.

12. The ink jet recording medium of item 4, wherein the inorganic pigment is alumina.

13. The ink jet recording medium of item 4, wherein at least one of the plural ink absorption layers except for the upper layer contains inorganic pigment in an amount of not less than 50% by weight.

14. An ink jet recording medium comprising a substrate and provided thereon, an upper layer containing inorganic pigment in an amount of 30 to 70% by weight and thermoplastic particles, the upper layer being a single layer, wherein the content ratio by weight of inorganic pigment/thermoplastic particles is from 3/7 to less than 7/3.

15. The ink jet recording medium of item 14, wherein the medium is subjected to image recording employing pigment ink.

16. The ink jet recording medium of item 14, wherein the medium is subjected to image recording and then subjected to heating treatment.

17. An ink jet recording medium comprising a substrate and provided thereon, plural ink absorption layers including an upper layer containing inorganic pigment in an amount of 30 to 70% by weight and thermoplastic particles, wherein the content ratio by weight of inorganic pigment/thermoplastic particles is from 3/7 to less than 7/3 by weight.

18. The ink jet recording medium of item 17, wherein the medium is subjected to image recording employing pigment ink.

19. The ink jet recording medium of item 17, wherein the medium is subjected to image recording and then subjected to heating treatment.

20. A method of manufacturing an ink jet recording medium comprising a substrate and provided thereon, plural ink absorption layers including an upper layer containing inorganic pigment and thermoplastic particles and a layer adjoining the upper layer, the method comprises the step of simultaneously coating the upper layer and the layer adjoining the upper layer on the substrate.

21. The method of item 20, wherein the upper layer contains inorganic pigment and thermoplastic particles, the content by weight of the inorganic pigment being greater than the content of the thermoplastic particles.

22. The method of item 20, wherein all of the plural ink absorption layers are simultaneously multi-layer coated.

23. A method of forming an ink jet image, the method comprising the steps of recording an ink jet image on the recording medium of any one of items 1, 4 through 14 and 17, and then melting the thermoplastic particles in the upper layer.

24. The method of item 23, wherein the ink jet image is recorded employing pigment ink.

25. The method of item 23, wherein the total image forming comprising the recording and the melting is carried out at a speed of 1 to 15 $m^2$/hour.

25. The method of item 23, wherein the melting is carried out by heating.

101. An ink jet recording medium comprising a substrate and provided thereon, plural ink absorption layers including an upper layer containing inorganic pigment and thermoplastic particles, the content of the inorganic pigment being greater than the content of the thermoplastic particles.

102. An ink jet recording medium comprising a substrate and provided thereon, plural ink absorption layers including an upper layer containing inorganic pigment and thermoplastic particles, the content of the inorganic pigment being greater than the content of the thermoplastic particles, wherein the medium is subjected to image recording employing pigment ink.

103. An ink jet recording medium comprising a substrate and provided thereon, plural ink absorption layers including an upper layer containing inorganic pigment and thermoplastic particles, the content of the inorganic pigment being greater than the content of the thermoplastic particles, wherein the medium is subjected to image recording and then subjected to heating treatment.

104. The ink jet recording medium of any one of items 101 to 103, wherein at least one of the plural ink absorption layers except for the upper layer contains inorganic pigment as the main component.

105. The ink jet recording medium of item 104, wherein the inorganic pigment is silica.

106. The ink jet recording medium of item 104, wherein the inorganic pigment is alumina.

107. A method of manufacturing an ink jet recording medium comprising a substrate and provided thereon, plural ink absorption layers including an upper layer containing inorganic pigment and thermoplastic particles and a layer adjoining the upper layer, the method comprises the step of simultaneously coating the upper layer and the layer adjoining the upper layer on the substrate.

108. The method of item 107, wherein the upper layer contains inorganic pigment and thermoplastic particles, the content of the inorganic pigment being greater than the content of the thermoplastic particles.

109. The method of item 107 or 108, wherein all of the plural ink absorption layers are simultaneously multi-layer coated.

110. A method of forming an ink jet image, the method comprising the steps of recording an ink jet image on the recording medium of any one of items 101 to 106, and then melting the thermoplastic particles in the upper layer to form a film.

111. The method of item 110, wherein the recording is carried out employing pigment ink.

112. The method of item 110, wherein the total image forming comprising the recording and the melting is carried out at a speed of 1 to 15 $m^2$/hour.

113. The method of any one of items 110 to 112, wherein the melting is carried out by heating.

114. An ink jet image, wherein the image is obtained by recording an ink jet image on the recording medium of any one of items 101 to 106, and then melting the thermoplastic particles in the upper layer to form a film.

115. The ink jet image of item 114, wherein the recording is carried out employing pigment ink.

116. The ink jet image of item 114 or 115, wherein the melting is carried out by heating.

The present invention will be explained in detail below.

The ink jet recording medium of item 1 is an ink jet recording medium comprising a substrate and provided thereon, plural ink absorption layers including an upper layer, wherein the upper layer contains inorganic pigment and thermoplastic particles, and the inorganic pigment content of the upper layer is greater than the thermoplastic fine particle content.

Substrates used in the invention include conventional substrates such as paper sheets, for example, a plain paper sheet, an art paper sheet, a coated paper sheet, and a caster coat paper sheet; a plastic sheet; a paper sheet laminated with polyethylene film on both sides; and a composite sheet thereof.

In the ink jet recording medium, in order to increase adhesion between a substrate and the ink absorption layer, the substrate is preferably subjected to corona discharge treatment or subbing treatment before the ink absorption layer coating. The ink jet recording medium of the invention need not be colorless, and may be colored.

In the ink jet recording medium of the invention, the substrate is preferably a base paper both surfaces of which are laminated with polyethylene in that a high quality image close to a photographic image is obtained at low cost. The polyethylene laminated paper will be explained below.

The base paper used in a substrate is papered employing a tree pulp with optional addition of a synthetic pulp such as polypropylene or a synthetic fiber such as nylon or polyester. The tree pulp includes LBKP, LBSP, NBKP, NBSP, LDP, NDP, LUKP, and NUKP. It is preferable that LBKP, NBSP, LBSP, NDP, LDP, or LUKP is used in a larger amount. The content of LBSP or LDP in the paper is preferably 10 to 70 weight %.

The above pulp is preferably a chemical pulp with reduced impurities (for example, sulfate of pulp or sulfite of pulp). The pulp bleached and increasing whiteness is useful. The base paper optionally contains a sizing agent such as higher fatty acid, an alkyl ketene dimer, white pigment such as calcium carbonate, talc, or titanium oxide, a paper strength increasing agent such as starch, polyacrylamide or polyvinyl alcohol, a fluorescent brightening agent, a moisture retaining agent such as polyethylene glycol, a dispersing agent, a softening agent such as a quaternary ammonium salt.

The freeness of the pulp is preferably 200 to 500 ml according to a CSF method, and the pulp fiber after beating has a total amount of pulp fiber remained on the 24 mesh and 42 mesh sieves of preferably 30 to 70 weight % according to JIS-P-8207. The pulp fiber has an amount of fiber remained on the 4 mesh sieve of preferably 20 weight % or less. The basis weight of the base paper is preferably 30 to 250 g/$m^2$, and more preferably 50 to 200 g/$m^2$. The thickness of the base paper is preferably 40 to 250 μm. The base paper can be subjected to calender treatment during of or after papering to give high smoothness. The density of the base paper is generally 0.7 to 1.2 g/$m^2$ (JIS-P-8118). The stiffness of the base paper is preferably 20 to 200 g under the conditions according to JIS-P-8143. The surface sizing agent may be coated on the surface of the paper, and the surface sizing agent includes those as described above which can be incorporated in the paper. The pH of the paper is preferably 5 to 9 according to a hot water extracting method as defined in JIS-P-8113.

The polyethylene with which both surfaces of the paper are laminated is mainly a low density polyethylene (LDPE) and/or a high density polyethylene (HDPE), but may be LLDPE or polypropylene. The polyethylene on the ink absorption layer side is preferably a polyethylene containing rutile or anatase type titanium oxide, whereby whiteness and translucency of the support are improved, as used in a photographic print paper. The titanium oxide content of the polyethylene is about 3 to 20 weight %, and preferably 4 to 13 weight %.

The polyethylene laminated paper may be a glossy paper, or a matted or silk finish paper as used in a photographic print paper. When the base paper is laminated with a polyethylene film according to a melt-extruding method, the surface of the polyethylene film is matted or silk finished by molding to obtain a matted or silk finish paper.

The amount of polyethylene laminated on the base paper is determined to be optimize curl of an ink jet recording sheet under high or low humidity after coating the void layer and the backing layer, but the thickness of the polyethylene on the void layer side is generally 20 to 40 μm, and the thickness of the polyethylene on the backing layer side is generally 10 to 30 μm.

The above polyethylene laminated support preferably has the following properties:

1. Tensile strength is preferably 20 to 300 N in the mechanical direction, and 10 to 200 N in the transverse direction according to JIS-P-8113.

2. Tearing strength is preferably 0.1 to 20 N in the mechanical direction, and 2 to 20 N in the transverse direction according to JIS-P-8116.

3. Compression elastic modulus ≧98.1 MPa

4. Beck smoothness of the surface according to JIS-P-8119 is preferably 20 seconds or more, but an embossed surface may have a Beck smoothness not more than 20 seconds.

5. Surface roughness according to JIS-B-0601 is a maximum height of preferably not more than 10 μm per a standard length of 2.5 cm.

6. Translucency according to JIS-P-8138 is preferably 80% or more, and more preferably 85 to 95%.

7. Whiteness: L* is preferably 80 to 95, a* is preferably −3 to +5, and b* is preferably −6 to +2, wherein L*, a* and b* are defined according to JIS-Z-8729.

8. Surface glossiness: A mirror surface glossiness at 60° according to JIS-Z-8741 is preferably 10 to 95%.

9. Clark rigidity: The support has a Clark rigidity of preferably 50 to 300 $cm^2$/100 in the transport direction of the recording medium.

10. Moisture content in center stock: The moisture content of the center stock is ordinarily 2 to 100% by weight, and preferably 2 to 6% by weight, based on the weight of the center stock.

Generally, the ink absorption layer is divided into a swell type ink absorption layer and a void type ink absorption layer.

The swell type ink absorption layer is an absorption layer containing one or more of hydrophilic binders such as gelatin, polyvinyl alcohol, polyvinyl pyrrolidone, and polyethylene oxide which is coated on a substrate.

The void type ink absorption layer is an absorption layer containing a mixture of fine particles and a hydrophilic binder which is coated on a substrate, and is preferably an ink absorption layer with glossiness. The fine particles are preferably alumina particles or silica particles, and more preferably silica particles with a particle size of not less than 0.1 μm. The hydrophilic binders are preferably gelatin, polyvinyl alcohol, polyvinyl pyrrolidone, and polyethylene oxide, and they are preferably used singly or in combination.

Of the above two, the void type ink absorption layer is preferable, in that it has a higher ink absorption rate when applied to a continuous high speed copier.

The void type ink absorption layer will be explained below.

The void layer is formed mainly from a hydrophilic binder and flocculated inorganic fine particles. Various methods are well known which form voids in a layer to obtain a void layer. The methods include one in which a coating solution containing two or more kinds of polymers is coated on a substrate, and allowed to cause phase separation of the polymers during drying to form a void layer, one in which a coating solution containing solid fine particles and a hydrophilic or hydrophobic binder is coated on a substrate, dried to obtain an ink jet recording sheet, and the resulting sheet is immersed in water or an organic solvent to form a void layer, one in which a coating solution containing a compound capable of foaming during layer formation is coated on a substrate, and then the compound is foamed during drying to form a void layer, one in which a coating solution containing porous fine particles and a hydrophilic binder is coated on a substrate to form voids in or between the porous fine particles whereby a void layer is formed, and one in which a coating solution containing a hydrophilic binder and solid fine particles or fine oil drops in an amount by volume identical to or more than the hydrophilic binder is coated on a substrate to form voids between the solid fine particles whereby a void layer is formed. In the invention, a void layer containing inorganic fine particles having an average particle size of not more than 100 nm is especially preferable.

Listed as fine inorganic particles which are employed to achieve the aforementioned objective are white inorganic pigments such as, for example, precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, false boehmite, aluminum hydroxide, lithopone, zeolite, magnesium hydroxide, and the like.

The average particle size of fine inorganic particles is determined in such a manner that fine particles themselves, or fine particles located at the cross-section or the surface of the void layer are observed employing an electron microscope, the size of randomly selected 100 particles are determined, and the simple average (number average) is computed. The size of each particle as described herein refers to the size of the circle which has the same projection area as said particle.

The fine inorganic particles are preferably solid fine particles selected from silica particles, alumina particles and alumina hydrate particles.

As the silica used in the invention, silica synthesized by a conventional wet method, colloidal silica, or silica fine particles synthesized by a gas phase method are preferably used, and colloidal silica, or silica fine particles synthesized by a gas phase method is more preferably used. The silica fine particles synthesized by a gas phase method is most preferable in that they provide a high void content, and are difficult to form large aggregates particularly when used in combination with cationic polymers used for fixing a colorant. The alumina or alumina hydrates may be either crystalline or non-crystalline. Further, it is possible to employ those which have any shape such indeterminate shape, spherical shape, needle-shape, and the like.

It is preferred that the fine inorganic particles are dispersed in form of the primary particles in the fine inorganic particle dispersion before mixed with cationic polymers.

The average primary particle size of fine inorganic particles is preferably not more than 100 nm. For example, in the case of said silica synthesized employing the above gas phase method, the average primary particle size (particle size in the dispersion prior to coating) of the silica particles, which are dispersed in a primary particle state, is preferably not more than 100 nm, more preferably from 4 to 50 nm, and most preferably from 4 to 20 nm.

Silica particles having an average primary particle size of 4 to 20 nm synthesized employing a gas phase method, which are most preferably used, include, for example, Aerosil manufactured by Nippon Aerosil Co. The fine silica particles according to a gas phase method can be comparatively easily dispersed in form of primary particles by suck dispersing the particles in water, for example, employing a jet stream inductor mixer produced by Mitamura Riken Kogyo Co., Ltd.

The hydrophilic polymers (hereinafter referred to also as water soluble polymers) used in the invention include polyvinyl alcohol, gelatin, polyethylene oxide, polyvinyl pyrrolidone, polyacrylic acid, polyacrylamide, polyurethane, dextrane, dextrin, carrageenan (κ, ι, λ), agar, pullulan, water soluble polyvinyl butyral, hydroxyethyl cellulose, and carboxymethyl cellulose. These hydrophilic binders may be used singly or in combination.

The hydrophilic binder preferably used in the invention is polyvinyl alcohol.

The polyvinyl alcohols preferably used in the invention include an ordinary polyvinyl alcohol obtained by hydrolyzing polyvinyl acetate, and a modified polyvinyl alcohol such as a cation-modified polyvinyl alcohol or an anion-modified polyvinyl alcohol.

The polyvinyl alcohol obtained by hydrolyzing polyvinyl acetate has an average polymerization degree of preferably not less than 1,000, and more preferably 1500 to 5,000. The polyvinyl alcohol has a saponification degree of preferably 70 to 100 mol %, and more preferably 80 to 99.5 mol %.

The cation-modified polyvinyl alcohol is a polyvinyl alcohol having a primary to tertiary amino group or a quaternary ammonium group in its main or side chain, and is obtained by saponifying a copolymer of vinyl acetate and an ethylenically unsaturated monomer having a cationic group.

Examples of the ethylenically unsaturated monomer having a cationic group include trimethyl-(2-acrylamide-2,2-dimethylethyl)ammonium chloride, trimethyl-(3-acrylamide-3,3-dimethylpropyl)ammonium chloride, N-vinylimidazole, N-vinyl-2-methylimidazole, N-(3-dimethylaminopropyl)methacrylamide, hydroxyethyltrimethylammonium chloride, trimethyl-(3-methacrylamidopropyl) ammonium chloride, and N-(1,1-dimethyl-3-dimethylaminopropyl)acrylamide.

The content of the monomer having a cationic group in the cation-modified polyvinyl alcohol is preferably 0.1 to 10 mol %, more preferably 0.2 to 5 mol %, based on the vinyl acetate content.

Examples of the anion-modified polyvinyl alcohol include polyvinyl alcohol having an anionic group disclosed in Japanese Patent O.P.I. Publication No. 1-206088, a copolymer of vinyl alcohol and a vinyl compound having a water-solubilizing group disclosed in Japanese Patent O.P.I. Publication Nos. 61-237681 and 63-307979, and a modified polyvinyl alcohol having a water-solubilizing group disclosed in Japanese Patent O.P.I. Publication Nos. 7-285265.

Examples of the nonion-modified polyvinyl alcohol include a polyvinyl alcohol derivative prepared by the addition of polyethylene oxide to a part of hydroxy groups of polyvinyl alcohol disclosed in Japanese Patent O.P.I. Publication No. 7-9758, and a block copolymer of a vinyl compound having a hydrophobic group and vinyl alcohol disclosed in Japanese Patent O.P.I. Publication No. 8-25795. Polyvinyl alcohols can be used as a mixture of two or more thereof, according to the polymerization degree and kinds of modification.

The addition amount of the fine inorganic particles in the ink absorption layer depends upon an ink absorption volume required, a void rate of a void layer, kinds of inorganic pigment or kinds of a water soluble resin, but is ordinarily 5 to 30 g, and preferably 10 to 25 g per $m^2$ of recording medium.

The ratio of fine inorganic particles to water soluble resins used in the ink absorption layer is ordinarily 2:1 to 20:1 by weight, and preferably 3:1 to 10:1 by weight.

The ink absorption layer may contain a cationic water soluble polymer having a quaternary ammonium group in the molecule, the cationic water soluble polymer content of the ink absorption layer is ordinarily 0.1 to 10 g, and more preferably 0.2 to 5 g per $m^2$ of ink jet recording medium.

The total void volume of the void layer is preferably not less than 20 ml per $m^2$ of the recording medium. When the void volume is less than 20 ml/$m^2$, ink supply in a small amount on recording results in excellent ink absorbability. However, ink supply in a large amount on recording tends to result in insufficient ink absorption and tends to produce problems in that the image quality is degraded, the rate of drying is low, and the like.

In the void layer having an ink retention property, the void rate is represented by the ratio of the void volume to the solid layer volume. The void rate is preferably not less than 50% in that the void layer is effectively formed without increasing the layer thickness.

Further, as another type void layer, other than the formation of the ink absorption layer employing fine inorganic particles, the ink absorption layer may be formed employing a coating composition comprising polyurethane resin emulsions, together with water-soluble epoxy compounds and/or acetoacetylated polyvinyl alcohol, and further, together with epichlorohydrin polyamide resins. In this case, preferred polyurethane resin emulsions are those having a particle size of 3.0 μm, and having a polycarbonate chain or a polycarbonate chain as well as a polyester chain. The polyurethane resins of the polyurethane resin emulsions comprises more preferably polyols having polycarbonate polyols or polycarbonate polyols as well as polyester polyols, polyurethane resins which have a sulfonic acid group in their molecule, in addition, epichlorohydrin polyamide resins, and water-soluble epoxy compounds and/or acetoacetylated vinyl alcohol. It is assumed that in the ink absorption layer prepared by employing the polyurethane resins, a weak aggregation of cations and anions is formed, and as a result, voids which exhibit ink solvent absorbing capability are formed, which make it possible to form the desired images.

The ink absorption layers in the invention are characterized in that they include an upper layer comprising thermoplastic particles and inorganic pigment in which the inorganic pigment content by weight is greater than the thermoplastic particle content by weight. The upper layer herein referred to is not limited to the uppermost layer, and is not specifically limited as long as the effects of the invention are obtained. In the invention, most of the effects of the invention take place when after image recording, the thermoplastic particles in the upper layer are melted by heating. If a recording medium comprising a lower layer comprising thermoplastic particles and inorganic pigment in which the inorganic pigment content by weight is greater than the thermoplastic particle content by weight, and which is not an uppermost layer, provides improved light fastness or improved water resistance when heated after recording in dye ink, as compared with light fastness or water resistance obtained when not heated, it is the recording medium falling within the invention. The upper layer in the invention is preferably the uppermost layer (or the outermost layer).

If a recording medium comprising a lower layer comprising thermoplastic particles and inorganic pigment in which the inorganic pigment content by weight is greater than the thermoplastic particle content by weight, and which is not an uppermost layer, provides improved glossiness, improved abrasion resistance or improved bronzing when heated after recording in pigment ink, as compared with glossiness, abrasion resistance or bronzing obtained when not heated, it is the recording medium falling within the invention.

Constitution examples comprising the upper layer in the invention will be shown below, but the invention is not limited thereto.

1. A recording medium comprising an uppermost layer comprising thermoplastic particles and inorganic pigment in which the inorganic pigment content by weight is greater than the thermoplastic particle content by weight.

2. A recording medium comprising a layer comprising thermoplastic particles and inorganic pigment in which the inorganic pigment content by weight is greater than the thermoplastic particle content by weight, and provided thereon, a thin layer for improving surface properties.

3. A recording medium comprising a layer comprising thermoplastic particles and inorganic pigment in which the inorganic pigment content by weight is greater than the thermoplastic particle content by weight, and provided thereon, a thin, UV absorption layer for cutting harmful rays.

4. A recording medium comprising a layer comprising thermoplastic particles and inorganic pigment in which the inorganic pigment content by weight is greater than the thermoplastic particle content by weight, and provided thereon, a layer comprising a matting agent.

5. A recording medium comprising a layer comprising thermoplastic particles and inorganic pigment in which the inorganic pigment content by weight is greater than the thermoplastic particle content by weight, and provided thereon, a peel layer capable of being peeled.

Among the above constitutions, the most preferable constitution is the constitution of paragraph 1 above, wherein the effects of the invention takes place most noticeably.

The upper layer in the invention containing inorganic pigment and thermoplastic particles may optionally contain a binder.

The inorganic pigment can be selected from the fine inorganic particles as described above which can be used in the ink absorption layer.

Listed as the inorganic pigment are white inorganic pigments such as, for example, precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, false boehmite, aluminum hydroxide, lithopone, zeolite, magnesium hydroxide, and the like.

The inorganic pigments are preferably solid fine particles selected from silica particles, alumina particles and alumina hydrate particles.

As the silica used in the invention, silica synthesized by a conventional wet method, colloidal silica, or silica fine particles synthesized by a gas phase method are preferably used, and colloidal silica, or silica fine particles synthesized by a gas phase method is more preferably used. The silica fine particles synthesized by a gas phase method is most preferable in that they provide a high void content, and are difficult to form large aggregates particularly when used in combination with cationic polymers used for fixing a colorant. The alumina or alumina hydrates may be either crystalline or non-crystalline. Further, it is possible to employ those which have any shape such indeterminate shape, spherical shape, needle-shape, and the like. Item 5 above is characterized in that silica particles are used as the inorganic pigment, and item 6 above is characterized in that alumina particles are used as the inorganic pigment. The silica particles are preferably used.

It is preferred that the inorganic pigments are dispersed in form of the primary particles in the pigment particle dispersion before mixed with cationic polymers.

The average primary particle size of inorganic pigment particles is preferably not more than 100 nm. The inorganic particles have an average primary particle size of more preferably 4 to 50 nm, and most preferably 4 to 20 nm. For example, in the case of said silica synthesized employing the above gas phase method, the average primary particle size (particle size in the dispersion prior to coating) of the silica particles, which are dispersed in a primary particle state, is preferably not more than 100 nm, more preferably from 4 to 50 nm, and most preferably from 4 to 20 nm.

Thermoplastic particles used in the invention include, for example, polycarbonate, polyacrylonitrile, polystyrene, polyacrylic acid, polymethacrylic acid, polyvinyl chloride, polyvinylidene chloride, polyvinyl acetate, polyester, polyamide, polyether, and copolymers thereof and salts thereof. A styrene-acrylate copolymer, a vinyl chloride-vinyl acetate copolymer, a vinyl chloride-acrylate copolymer, an ethylene-vinyl acetate copolymer, an ethylene-acrylate copolymer, or SBR latex is preferred. The thermoplastic particles may be used as a mixture of plural polymers different from another in monomer composition, particle size or polymerization degree.

When the thermoplastic particles are selected, it is essential to take into account ink receptivity, image glossiness after fixing under an application of heat as well as an application of pressure, image durability, and releasability.

The average particle size of the thermoplastic particles in the upper layer is preferably from 0.05 to 10 μm, in that the ink absorption speed of the layer is increased and the layer strength as well as glossiness of the layer is improved. The average particle size of the thermoplastic particles is preferably from 0.05 to 10 μm, more preferably from 0.1 to 5 μm, and most preferably 0.1 to 1 μm.

Further, listed as the standard for selecting thermoplastic particles is the glass transition point (Tg). When Tg is lower than the coating drying temperature, for example, the coating drying temperature during the production of a recoding medium, is higher than Tg, voids, which are formed by thermoplastic particles, disappear due to the penetration of ink solvents. Further, when Tg is not lower than the temperature at which the substrate is subjected to modification due to heat, fixing operation is needed at high temperature in order to heat-melt the particles after ink jet recording employing a pigment ink. As a result, load applied to the apparatus, heat stability of the substrate used, and the like become problematic. The Tg of the thermoplastic particles is preferably from 50 to 150° C.

The minimum film manufacturing temperature (MFT) is preferably from 50 to 150° C. The thermoplastic particles are preferably dispersed in an aqueous dispersion in view of environmental concern, and more preferably dispersed in aqueous latex which is prepared by emulsion polymerization. In emulsion polymerization, a nonionic surfactant is preferably used as an emulsifying agent. The residual monomer content in the thermoplastic particles is preferably less, and the content is preferably not more than 3% by weight, more preferably not more than 1% by weight, and most preferably not more than 0.1% by weight.

In one embodiment of the ink jet recording medium of the invention, the upper layer comprises inorganic pigment and thermoplastic particles in which the inorganic pigment content by weight is greater than the thermoplastic particle content by weight, and the content ratio of thermoplastic particles/inorganic pigment is preferably from 45/55 to 10/90 by weight, and more preferably from 40/60 to 20/80 by weight.

Another embodiment of the ink jet recording medium of the invention is an ink jet recording medium comprising a substrate and provided thereon, an upper layer containing inorganic pigment in an amount of 30 to 70% by weight and thermoplastic particles, the upper layer being a single layer, wherein the content ratio by weight of inorganic pigment/thermoplastic particles is from 3/7 to less than 7/3.

Further another embodiment of the ink jet recording medium of the invention is an ink jet recording medium comprising a substrate and provided thereon, plural ink absorption layers including an upper layer containing inorganic pigment in an amount of 30 to 70% by weight and thermoplastic particles, wherein the content ratio by weight of inorganic pigment/thermoplastic particles is from 3/7 to less than 7/3 by weight.

The solid content of the upper layer comprising inorganic pigment and thermoplastic particles is not specifically limited, but is preferably from 2 to 50 g/m$^2$, and more preferably from 3 to 30 g/m$^2$.

The solid content of the thermoplastic particles contained in the upper layer of the recording medium of the invention is preferably from 0.5 to 15 g/m$^2$, and more preferably from 1 to 7 g/m$^2$. The above thermoplastic particle content range is preferable in that good image quality and good surface glossiness are obtained, and ink absorption speed is increased, resulting in prevention of ink bleed.

An upper layer coating solution comprising inorganic pigment and thermoplastic particles can be obtained by simultaneously dispersing inorganic pigment and thermoplastic particles in a solvent or by mixing an inorganic pigment dispersion with a thermoplastic particle dispersion.

Recording on the recording medium of the invention can be carried out in any of dye ink, pigment ink, aqueous ink, oily ink, or hot-melt ink. An aqueous dye ink, an aqueous pigment ink, and an oily pigment ink are suitable for the recording, an aqueous dye ink and an aqueous pigment ink is more suitable, and an aqueous pigment ink is most suitable.

In the method of the invention of recording an image, the thermoplastic particles contained in the upper layer of the recording medium are melted according to some method after ink jet recording. Such a method is preferable in view of improved image quality or image storage stability. In the image recording method of the invention, the thermoplastic particles are melted preferably by heating.

A manufacturing method of the ink jet recording medium of the invention will be explained below.

The ink jet recording medium can be manufactured by coating each of plural ink absorption layers singly or coating plural ink absorption layers simultaneously according to a conventional coating method, and drying the coated layer. As the coating methods are preferably used a roller coating method, a rod-bar coating method, an air-knife coating method, a spray coating method, and a curtain coating method and an extrusion coating method using a hopper disclosed in U.S. Pat. Nos. 2,761,419 and 2,761,791.

In the method of the invention of manufacturing an ink jet recording medium comprising plural ink absorption layers including an upper layer comprising inorganic pigment and thermoplastic particles, the method comprises the step of simultaneously coating the upper layer and one layer adjoining to the upper layer on a substrate. In the method of the invention, the inorganic pigment content is preferably greater than the thermoplastic particle content. The most preferred coating method is a method wherein all the plural ink absorption layers are simultaneously coated.

In the simultaneous coating, viscosity of each coating solution, when a slide bead coating method is used, is preferably 5 to 100 mPa·s, and more preferably 10 to 50 mPa·s. Viscosity of each coating solution, when a curtain coating method is used, is preferably 5 to 1200 mpa·s, and more preferably 25 to 500 mpa·s.

Viscosity of the coating solution at 15° C. is preferably not less than 100 mPA·s, more preferably 100 to 30,000, still more preferably 3,000 to 30,000 mPA·s, and most preferably 10,000 to 30,000 mPA·s.

The method of coating and drying is preferably a method in which coating solutions heated to not less than 30° C. are simultaneously coated on a substrate, the resulting coated layers are cooled to 1 to 15° C., and dried at not less than 10° C. Preparation of coating solutions, coating and drying are preferably carried out at a temperature of not more than Tg of thermoplastic particles to be contained in the upper layer, so that the thermoplastic particles are not melted. Drying is preferably carried out under conditions of a wet-bulb temperature of 5 to 50° C. and a film surface temperature of 10 to 50° C. The cooling method after coating is preferably a horizontal set method in forming a uniform layer.

The method of forming an ink jet image of the invention will be explained below.

The ink jet image of the invention can be obtained by recording an image on a recording medium employing an ink jet printer. In the invention, the ink jet image forming method comprises the steps of recording images and then melting thermoplastic particles contained in the upper layer by post treatment. The post treatments for melting the thermoplastic particles include a method of supplying an organic solvent capable of melting the thermoplastic particles onto the recorded images, employing, for example, an ink jet head and a method of applying heat to the recorded images. In the invention, the thermoplastic particles are melted preferably by heat application.

Examples of ink used in image recording include an aqueous ink composition, an oily ink composition, a solid (capable of varying its phase) ink composition. An aqueous ink containing not less than 19% by weight of water is preferably used for ink jet recording.

Colorants used in ink include a water soluble dye such as an acid dye, a direct dye or a reactive dye; a disperse dye; and pigment.

In the invention, pigment ink was preferably used for ink jet recording. The use of the pigment ink is especially preferable in view of improved image storage stability. As pigment used in the pigment ink, organic pigment such as insoluble pigment or lake pigment and carbon black are preferably used.

Insoluble pigment is not specifically limited, but is preferably azo, azomethine, polymethine, diphenylmethane, triphenylmethane, quinacridone, anthraquinone, perylene, indigo, quinophthalone, isoindolinone, isoindoline, azine, oxazine, thiazine, dioxazine, thiazole, phthalocyanine, and diketopyrrolopyrrole.

Typical organic pigment preferably used will be exemplified below.

Listed as pigment for magenta or red, are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigment for orange or yellow, are C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 128, C.I. Pigment Yellow 138, and the like.

Listed as pigment for green or cyan, are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

The pigment dispersing agent may be optionally used. Listed as dispersing agents of the present invention may be, for example, surface active agents such as higher fatty acid salts, alkyl sulfonic acid salts, alkylestersulfonic acid salts, alkylsulfonic acid salts, sulfosuccinic acid salts, naphthalenesulfonic acid salts, alkylphosphoric acid salts, polyoxyalkylene alkyl ether phosphoric acid salts, polyoxyalkylene alkyl phenyl ether, polyoxyethylene polyoxypropylene glycol, glycerin ester sorbitan ester, polyoxyethylene fatty acid amide, amine oxide, and the like, or block copolymers and random copolymers having at least two monomers selected from styrene, styrene derivatives, vinyl naphthalene derivatives, acrylic acid, acrylic acid derivatives, maleic acid, maleic acid derivatives, itaconic acid, itaconic acid derivatives, fumaric acid, and fumaric acid derivatives, and salts thereof.

Employed as pigment ink dispersion methods may be any type such as a ball mill, a sand mill, an atriter, a roll mill, an agitator, a Henschel mixer, a colloid mill, an ultrasonic homogenizer, a pearl mill, a wet type jet mill, a paint shaker, and the like. For the purpose of removing coarse particle components of the pigment ink dispersion of the present invention, centrifugal apparatus, as well as filters, are preferably employed.

The average particle size of the pigment particles in pigment ink is selected in view of ink stability, image density, glossiness, or light fastness, and in the image forming method according to the invention, the particle size is preferably selected in view of improved glossiness or image quality. The reason of improving glossiness or quality in the invention is not clear, but is considered to relate to pigment dispersed in a preferable state in a melted film of the thermoplastic particles. In order to attain high speed processing, it is necessary that thermoplastic particles be melted in a short time, and pigment be uniformly dispersed in the layer. Herein, the surface area of the pigment has a great influence on the dispersion, and therefore, the pigment is considered to have an optimum average particle size range.

The preferred pigment ink is an aqueous ink composition containing a water miscible organic solvent. Examples of the water miscible organic solvent used in pigment ink of the invention include alcohols (for example, methanol, ethanol, propanol, iso-propanol, butanol, iso-butanol, sec-butanol, tert-butanol, pentanol, hexanol, cyclohexanol, benzyl alcohol, etc.); polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, thiodiglycol, etc.); polyhydric alcohol ethers (for example, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, diethylene glycol dimethyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, triethylene glycol dimethyl ether, dipropylene glycol monopropyl ether, tripropylene glycol dimethyl ether); amines (for example, ethanolamine, diethanolamine, triethanolamine, N-methyldiethanolamine, N-ethyldiethanolamine, morpholine, N-ethylmorpholine, ethylenediamine, diethylenediamine, triethylenetetramine, tetraethylenepentamine, polyethyleneimine, pentamethyldiethylenetriamine, tetramethylpropylenediamine, etc.); amides (for example, formamide, N, N-dimethylformamide, N,N-dimethylacetamide, etc.); heterocycles (for example, 2-pyrrolidone, N-methyl-2-pyrrolidone, N-cyclohexyl-2-pyrrolidone, 2-oxazolidone, 1,3-dimethyl-2-imidazolidinone, etc.); sulfoxides (for example, dimethylsulfoxide, etc.); sulfones (for example, sulfolane, etc.); sulfonic acid salts (for example, sodium 1-butane sulfonate, etc.); urea; acetonitrile; and acetone. As the water miscible organic solvent, polyhydric alcohols are preferred, and a combination of polyhydric alcohol and polyhydric alcohol ethers is more preferred.

These water miscible organic solvents may be employed singly or as a mixture of two or more kinds thereof. The water miscible organic solvent content of ink is 5 to 60% by weight, and preferably 10 to 35% by weight.

The ink composition can contain conventional additives such as viscosity regulating agents, specific resistance regulating agents, film forming agents, ultraviolet light absorbing agents, anti-oxidants, anti-fading agents, rust-proof agents, antiseptics, and mildewcides for the purpose of improvement of ink jetting stability, suitability for an ink cartridge, storage stability, image quality permanence, or other performances. Examples of the additives include polystyrene, polyacrylates, polymethacrylates, polyacrylamides, polyethylene, polypropylene, polyvinyl chloride, polyvinylidene chloride, or their copolymers, organic latexes such as a urea resin and a melamine resin, oil drops such as liquid paraffin, dioctyl phthalate, tricresyl phosphate and silicone oil, various surfactants such as cationic and nonionic surfactants, a UV absorbent disclosed in Japanese Patent O.P.I. Publication Nos. 57-74193, 57-87988 and 62-261476, an anti-fading agent disclosed in Japanese Patent O.P.I. Publication Nos. 57-74192, 57-87989, 60-72785, 61-146591, 1-95091 and 3-13376, a fluorescent brightening agent, and a pH adjusting agent such as sulfuric acid, phosphoric acid, citric acid, sodium hydroxide, potassium hydroxide or potassium carbonate.

The ink composition has a viscosity at jetting of preferably not more than 40 mpa·s, and more preferably not more than 30 mPa·s. The ink composition has a surface tension at jetting of preferably not less than 20 mN/m, and more preferably 30 to 45 mN/m.

The preferred embodiment of the invention is to record an ink jet image on the recording medium and then melt the thermoplastic particles in the resulting medium by heating. The heating treatment, whereby the thermoplastic particles in the recording medium are melted, is carried out in order to improve image quality such as appearance, glossiness, or bronzing, and to enhance abrasion resistance. In the heating treatment, heat necessary to completely melt the thermoplastic particles is preferably applied. In contrast, when heating treatment is carried out in a short time in order to shorten the processing time, the thermoplastic particles may not be completely melted unless the resulting image quality is substantially different from that obtained when the thermoplastic particles are completely melted.

In order to apply a necessary heat in a short time, heating element providing a temperature as high as possible is preferably used. However, excessively high temperature may damage a support, and produce a marked curl, image roughness or contamination of rollers. The temperature for the heating is preferably 100 to 100° C., and more preferably 100 to 150° C.

The heating treatment may be carried out employing a built-in heating device or another heating device. Heating rollers are suitable to prevent image unevenness, and carry out continuous processing at a small space. The fixing device used in an electrophotographic copier is advantageously used in view of cost reduction. That is, a recording medium may be heated and pressed passing between a heated roller containing a heating element therein and a pressure roller, or may be heated passing between a pair of heated rollers.

The heating roller is hollow and rotated by a driving means. The roller has within the interior a heating element as a heating source such as a halogen lamp heater, a ceramic heater, or nichrome wire. Materials of the roller are preferably those having high heat conductivity, and more preferably metals. The surface of the roller is preferably coated with a fluorine-containing resin. Silicone gum rollers whose surface is coated with heat resistant silicone resin can be also used.

When the heating roller is used, the transport speed of recording medium is preferably 1 to 15 mm/second. This speed has been proved to be a preferable speed in view of improved image quality as well as high speed processing. In order to obtain a higher image quality and glossiness, pressure is preferably applied at the same time as or after the heating treatment. The applied pressure is preferably 9.8 to $10^4$ to $4.9\times10^6$ Pa, whereby film formation is accelerated.

A printer employed in the image formation of the invention will be explained below.

The printer used in the invention is not specifically limited, as long as it is a printer which comprises a recording medium tray, recording medium transport section, an ink cartridge, and an ink jet print head, as a commercially available printer. In the invention, a printer is preferable a printer set comprised of a section for housing a recording medium in the roll form, a transport section, an ink jet print head, a cutting section, and optionally a heating section, a pressure section or a section for housing a recording medium with a recorded image. The recording head may be any of a piezo type, a thermal type or a continuous type, but a piezo type is preferable in view of stability of pigment ink.

EXAMPLES

The present invention will be explained with reference to the examples. However, the present invention is not limited to these embodiments.

Example 1

(Preparation of Ink Jet Recording Medium)

An ink jet recording medium was prepared according to the following procedures.

(Preparation of Titanium Oxide Dispersion Solution-1)

Twenty kilograms of titanium oxide particles (W-10, produced by Ishihara Sangyo Co., Ltd.) having an average particle diameter of 0.25 μm were added to 90 liters of an aqueous solution with a pH of 7.5 containing 150 g of sodium tripolyphosphate, 500 g of polyvinyl alcohol (PVA235, an average polymerization degree of 3500, produced by Kuraray Co., Ltd.), 150 g of cationic polymer (P-1) and 10 g of a defoaming agent SN381 (produced by Sannobuko Co., Ltd.) in a high pressure homogenizer (produced by Sanwa Kogyo Co., Ltd.), and dispersed. Water was added to make a 100 liter dispersion solution. Thus, titanium oxide dispersion solution-1 was obtained.

P-1

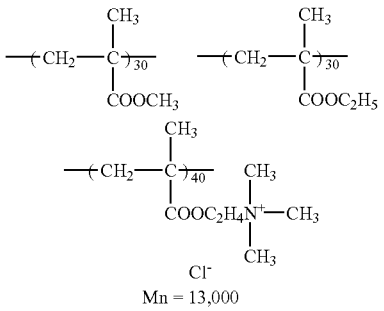

(Preparation of Silica Dispersion Solution-1)

In 620 liters of pure water, whose pH was adjusted to 2.5 using nitric acid, were suction-dispersed 125 kg of gas phase method silica particles (A300, Nippon Aerosil Kogyo Co., Ltd.) having an average primary particle size of 0.007 μm, employing a Jet Stream Inductor Mixer TDS manufactured by Mitamura Riken Kogyo Co., Ltd. Thereafter, the total volume was adjusted to 694 liters, employing pure water. Thus, silica dispersion solution-1 was prepared. Particles in the diluted dispersion solution were photographed employing an electron microscope. It was confirmed that not less than 85 percent of the total particles in the photograph had a particle size of not more than 0.01 μm and the particles were dispersed in the form of the primary particles.

(Preparation of Silica Dispersion Solution-2)

To 18 liters of a solution (maintained at a pH of 2.3) containing 1.41 kg of cationic polymer (P-2) and 4.2 liters of ethanol were added 69.4 liters of silica dispersion solution-1 obtained above at a temperature range of from 25 to 30° C. over 20 minutes, while stirring. Subsequently, 7.0 liters of an aqueous solution (at a pH of 7.3) containing 260 g of boric acid and 230 g of sodium tetraborate dacahydrate were added while stirring to the resulting mixture over 10 minutes, and 1 g of a defoaming agent SN381 was added. The resulting mixture was subjected to double dispersion under a pressure of 24.5 MPa, employing a high pressure homogenizer manufactured by Sanwa Kogyo Co., Ltd. Pure water was added to the resulting dispersion solution to make a 97 liter dispersion solution. Thus, silica dispersion solution-2, which was nearly transparent, was prepared.

P-2

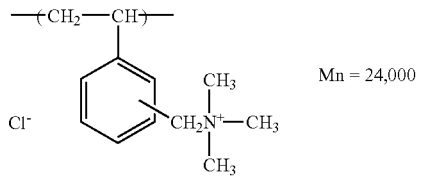

(Preparation of Silica Dispersion Solution-3)

In 620 liters of pure water, whose pH was adjusted to 2.5 using nitric acid, were suction-dispersed 125 kg of gas phase method silica particles (QS-20, produced by Tokuyama Co., Ltd.) having an average primary particle size of 0.012 μm, employing a Jet Stream Inductor Mixer TDS manufactured by Mitamura Riken Kogyo Co., Ltd. Thereafter, pure water was added to the resulting dispersion solution to make a 694 liter dispersion solution. Thus, silica dispersion solution-3 was prepared.

(Preparation of Silica Dispersion Solution-4)

To 18 liters of a solution (maintained at a pH of 2.3) containing 1.14 kg of cationic polymer (P-1) above, 2.2 liters of ethanol and 1.5 liters of n-propanol were added 69.4 liters of silica dispersion solution-3 obtained above, while stirring. Subsequently, 7.0 liters of an aqueous solution (at a pH of 7.3) containing 260 g of boric acid and 230 g of borax were added to the resulting mixture, and 1 g of a defoaming agent SN381 (produced by Sannobuko Co., Ltd.) was added. The resulting mixture was subjected to double dispersion under a pressure of 24.5 MPa, employing a high pressure homogenizer manufactured by Sanwa Kogyo Co., Ltd. Pure water was added to the resulting dispersion solution to make a 97 liter dispersion solution. Thus, silica dispersion solution-4 was prepared.

(Preparation of Silica Dispersion Solution-5)

In 215 liters of pure water, whose pH was adjusted to 2.5 using nitric acid, were suction-dispersed 125 kg of gas phase method silica particles (A50, Nippon Aerosil Kogyo Co., Ltd.) having an average primary particle size of 0.03 μm, employing a Jet Stream Inductor Mixer TDS manufactured by Mitamura Riken Kogyo Co., Ltd. Thereafter, the resulting dispersion solution was adjusted to a dispersion solution having a solid concentration of 40 weight/volume percent. Thus, silica dispersion solution-5 was prepared.

(Preparation of Silica Dispersion Solution-6)

To an aqueous solution, in which 0.56 kg of cationic polymer (P-1) above were dissolved in 27.2 kg of deionized water, were added 63.0 liters of silica dispersion solution-5 obtained above, while stirring. Subsequently, 8.8 liters of an aqueous 6% boric acid solution were added to the resulting mixture, and 1 g of a defoaming agent SN381 (produced by Sannobuko Co., Ltd.) was added. The resulting mixture was adjusted to pH 4.4 employing a 6% nitric acid solution and dispersed, employing a high pressure homogenizer manufactured by Sanwa Kogyo Co., Ltd. Pure water was added to the resulting dispersion solution to make a 99.7 liter dispersion solution. Thus, silica dispersion solution-6 was prepared.

(Preparation of Fluorescent Brightening Agent Dispersion Solution-1)

Four hundred grams of oil soluble fluorescent brightening agent UVITEX-OB (produced by Chiba Geigy Co., Ltd.) were added to a mixture solution of 9.0 kg of diisodecylphthalate and 12 L of ethyl acetate, heated to obtain a solution, and the resulting solution was mixed with 65 L of an aqueous solution containing 3.5 kg of acid-processed gelatin and 6,000 ml of an aqueous 50% cationic polymer P-2 solution. The resulting mixture was dispersed at a pressure of 24.5 Mpa three times in a high pressure homogenizer (produced by Sanwa Kogyo Co., Ltd.). After the ethyl acetate was distilled out under reduced pressure, water was added to make a 100 liter dispersion solution. The pH of the resulting dispersion solution was approximately 5.3. Thus, fluorescent brightening agent dispersion solution-1 was prepared.

Preparation of Thermoplastic Particle Coating Solution (Preparation of Thermoplastic Particle Coating Solution-1)

A styrene-acryl polymer latex (Tg: 78° C., an average particle size of 250 nm, a solid content of 40% by weight) was prepared by emulsion polymerization employing a protective colloid as an emulsifying agent, and adjusted to pH 4.7 with an aqueous 6% nitric acid solution. Thus, thermoplastic particle coating solution-1 was prepared.

(Preparation of Thermoplastic Particle Coating Solution-2)

Vinibran 602 (Tg: 63° C., MFT: 130° C., produced by Nissin Chemical Industry Co., Ltd.), a vinyl chloride type copolymer emulsion, was adjusted to pH 4.7 with an aqueous 6% nitric acid solution and further adjusted to give a viscosity at 43° C. of 45 cp. Thus, thermoplastic particle coating solution-2 was prepared.

(Preparation of Thermoplastic Particle Coating Solution-3)

A styrene-acryl polymer latex (Tg: 78° C., an average particle size of 170 nm, a solid content of 38% by weight) was prepared by emulsion polymerization employing a protective colloid as an emulsifying agent, and adjusted to pH 4.7 with an aqueous 6% nitric acid solution. Thus, thermoplastic particle coating solution-3 was prepared.

(Preparation of Thermoplastic Particle Coating Solution-4)

A styrene-acryl polymer latex (Tg: 65° C., an average particle size of 260 nm, a solid content of 40% by weight) was prepared by emulsion polymerization employing a protective colloid as an emulsifying agent, and adjusted to pH 4.7 with an aqueous 6% nitric acid solution. Thus, thermoplastic particle coating solution-4 was prepared.

Preparation of Coating Solutions

Solutions were prepared as described below, and filtered employing a commercially available filter paper (TCP10 or TCP30 produced by Toyo Roshi Co., Ltd.) to prepare coating solutions.

(Preparation of Coating Solution 1)

The following agents were added in the order to 600 ml of silica dispersion solution-2 obtained above at 40° C. with stirring.

| | |
|---|---|
| Aqueous 7% solution of polyvinyl alcohol (PVA235, average polymerization degree of 3500, produced by Kuraray Co., Ltd.) | 194.6 ml |
| Fluorescent brightening agent dispersion solution-1 | 25 ml |
| Titanium oxide dispersion solution-1 | 33 ml |
| Latex emulsion (AE-803, produced by Daiichi Kogyo Co., Ltd.) | 18 ml |

Pure water was added to make a 1,000 ml solution, the pH of which was 4.4. Thus, coating solution 1 was obtained.

(Preparation of Coating Solution 2)

The following agents were added in the order to 650 ml of silica dispersion solution-2 obtained above at 40° C. with stirring.

| | |
|---|---|
| Aqueous 7% solution of polyvinyl alcohol (PVA235, average polymerization degree of 3500, produced by Kuraray Co., Ltd.) | 201.6 ml |
| Fluorescent brightening agent dispersion solution-1 | 35 ml |

Pure water was added to make a 1,000 ml solution, the pH of which was 4.4. Thus, coating solution 2 was obtained.

(Preparation of Coating Solution 3)

The following agents were added in the order to 650 ml of silica dispersion solution-2 obtained above at 40° C. with stirring.

| | |
|---|---|
| Aqueous 7% solution of polyvinyl alcohol (PVA235, average polymerization degree of 3500, produced by Kuraray Co., Ltd.) | 201.6 ml |
| Silicone dispersion solution (BY-22-839, produced by Toray Dow coning Silicone Co., Ltd.) | 15 ml |
| An aqueous 50% saponin solution | 4 ml |

Pure water was added to make a 1,000 ml solution, the pH of which was 4.5. Thus, coating solution 3 was obtained.

(Preparation of Coating Solution 4)

The following agents were added in the order to 600 ml of silica dispersion solution-4 obtained above at 40° C. with stirring.

| | |
|---|---|
| Aqueous 10% solution of polyvinyl alcohol (PVA203, produced by Kuraray Co., Ltd.) | 6 ml |
| Aqueous 7% solution of polyvinyl alcohol (PVA235, produced by Kuraray Co., Ltd.) | 185 ml |

Pure water was added to make a 1,000 ml solution. Thus, coating solution 4 was obtained.

(Preparation of Coating Solution 5)

The thermoplastic particle coating solution 1 and coating solution 2 were mixed so that the thermoplastic particles/inorganic pigment ratio by solid weight was 70/30, and water was added to the resulting mixture to give a viscosity at 43° C. of 45 cp. Thus, coating solution 5 was prepared.

(Preparation of Coating Solution 6)

Coating solution 6 was prepared in the same manner as in coating solution 5, except that the thermoplastic particles/inorganic pigment ratio by solid weight was 45/55.

(Preparation of Coating Solution 7)

Coating solution 7 was prepared in the same manner as in coating solution 5, except that the thermoplastic particles/inorganic pigment ratio by solid weight was 40/60.

(Preparation of Coating Solution 8)

Coating solution 8 was prepared in the same manner as in coating solution 5, except that the thermoplastic particles/inorganic pigment ratio by solid weight was 30/70.

(Preparation of Coating Solution 9)

Coating solution 9 was prepared in the same manner as in coating solution 5, except that the thermoplastic particles/inorganic pigment ratio by solid weight was 20/80.

(Preparation of Coating Solution 10)

Coating solution 10 was prepared in the same manner as in coating solution 5, except that the thermoplastic particles/inorganic pigment ratio by solid weight was 10/90.

(Preparation of Coating Solution 11)

The thermoplastic particle coating solution 2 and coating solution 2 were mixed so that the thermoplastic particles/inorganic pigment ratio by solid weight was 30/70, and water was added to the resulting mixture to give a viscosity at 43° C. of 45 cp. Thus, coating solution 11 was prepared.

(Preparation of Coating Solution 12)

The thermoplastic particle coating solution 3 and coating solution 2 were mixed so that the thermoplastic particles/inorganic pigment ratio by solid weight was 30/70, and water was added to the resulting mixture to give a viscosity at 43° C. of 45 cp. Thus, coating solution 12 was prepared.

(Preparation of Coating Solution 13)

The thermoplastic particle coating solution 4 and coating solution 2 were mixed so that the thermoplastic particles/inorganic pigment ratio by solid weight was 30/70, and water was added to the resulting mixture to give a viscosity at 43° C. of 45 cp. Thus, coating solution 13 was prepared.

(Preparation of Coating Solution 14)

The thermoplastic particle coating solution 1 and coating solution 4 were mixed so that the thermoplastic particles/inorganic pigment ratio by solid weight was 30/70, and water was added to the resulting mixture to give a viscosity at 43° C. of 45 cp. Thus, coating solution 11 was prepared.

(Preparation of Coating Solution 15)

The following agents were added in the order to 710 ml of silica dispersion solution-6 obtained above at 40° C. with stirring.

| | |
|---|---|
| Aqueous 10% solution of polyvinyl alcohol (PVA203, produced by Kuraray Co., Ltd.) | 3 ml |
| Aqueous solution containing 4.8% of polyvinyl alcohol PVA235 (produced by Kuraray Co., Ltd.) and 1.84% of polyvinyl alcohol PVA245 (produced by Kuraray Co., Ltd.) | 273 ml |

Pure water was added to make a 1,000 ml solution. Thus, coating solution 15 was obtained.

(Preparation of coating solution 16)

A mixture of 100 parts of alumina hydrate Cataloid AS-3 (produced by Shokubai Kagaku Co., Ltd.) and 30 parts of polyvinyl alcohol PVA117 (produced by Kuraray Co., Ltd.) was dispersed to prepare coating solution 16.

(Preparation of Coating Solution 17)

The thermoplastic particle coating solution 1 and coating solution 16 were mixed so that the thermoplastic particles/inorganic pigment ratio by solid weight was 30/70. Thus, coating solution 17 was prepared.

(Preparation of Coating Solution 18)

A mixture of 100 parts by weight of zinc oxide, 25 parts by weight of polyvinyl alcohol, 5 parts by weight and 500 parts by weight were mixed to prepare coating solution 18.

(Preparation of coating Solution 19)

Chemipearl W-300 produced by Mitsui Kagaku Co., Ltd. was used as coating solution 19.

(Preparation of Coating Solution 20)

Coating solution 20 was prepared in the same manner as in coating solution 5, except that the thermoplastic particles/inorganic pigment ratio by solid weight was 50/50.

(Preparation of Coating Solution 21)

Coating solution 21 was prepared in the same manner as in coating solution 5, except that the thermoplastic particles/inorganic pigment ratio by solid weight was 60/40.

(Preparation of Coating Solution 22)

Coating solution 22 was prepared in the same manner as in coating solution 5, except that the thermoplastic particles/inorganic pigment ratio by solid weight was 65/35.

(Preparation of Coating Solution 23)

The thermoplastic particle coating solution 1 and coating solution 2 were mixed so that the thermoplastic particles/inorganic pigment ratio by solid weight was 65/35, and water was added to the resulting mixture to give a viscosity at 43° C. of 45 cp. Thus, coating solution 23 was prepared.

(Preparation of Coating Solution 24)

The thermoplastic particle coating solution 3 and coating solution 2 were mixed so that the thermoplastic particles/inorganic pigment ratio by solid weight was 50/50, and water was added to the resulting mixture to give a viscosity at 43° C. of 40 cp. Thus, coating solution 24 was prepared.

(Preparation of Coating Solution 25)

The thermoplastic particle coating solution 4 and coating solution 2 were mixed so that the thermoplastic particles/inorganic pigment ratio by solid weight was 50/50, and water was added to the resulting mixture to give a viscosity at 43° C. of 40 cp. Thus, coating solution 25 was prepared.

Preparation of Ink Jet Recording Medium

Preparation of Comparative Sample 1

A coating solution corresponding to a first layer in Table 1, a coating solution corresponding to a second layer in Table 1, and a coating solution corresponding to a third layer in Table 1 were simultaneously coated in that order on a 220 μm thick paper support RC paper, in which a polyethylene film was laminated on both surfaces of a base paper, employing a slide hopper to give a wet thickness as shown in Table 1, and dried. Herein, in the paper support, the polyethylene film laminated on the surface of the base paper on the ink absorption layer side contained an anatase type titanium oxide in an amount of 13% by weight. Immediately after each coating solution was coated at 40° C., the coated material was cooled in a cooling zone maintained at 0° C. for 20 seconds, and dried supplying an air of 25° C. and 15% RH for 60 seconds, supplying an air of 45° C. and 25% RH for 60 seconds, and then supplying an air of 50° C. and 25% RH for 60 seconds. The resulting material was allowed to stand at 20 to 25° C. and 40 to 60% RH for 2 minutes, and wound. Thus, comparative sample 1 was obtained.

(Preparation of Comparative Sample 2)

Comparative sample 2 was prepared by coating a coating solution corresponding to a fourth layer as shown in Table 1 on the third layer of Comparative sample 1.

(Preparation of Comparative Sample 3)

On the Comparative sample 2 was coated a thermoplastic particle coating solution 1 (hereinafter referred to also as L1) obtained above, employing a blade coater to give a thermoplastic particle content of 5 g/m$^2$ and dried in the same manner as in Comparative sample 1. Thus, Comparative sample 3 was prepared.

(Preparation of Comparative Sample 4)

Comparative sample 4 was prepared in the same manner as in Comparative sample 3, except that thermoplastic particle coating solution 2 (hereinafter referred to also as L2) was used instead of L1.

(Preparation of Comparative Sample 5)

Comparative sample 5 was prepared in the same manner as in Comparative sample 1, except that the first layer, the second layer and the third layer, each being as shown in Table 1, were coated in that order on the substrate, and the fourth layer as shown in Table 1 was coated on the third layer.

(Preparation of Samples (Inventive) 1 through 11)

Samples (Inventive) 1 through 11 were prepared in the same manner as in comparative sample 2, except that kinds of each of the first, second, third and fourth layers and the wet thickness were changed to those as shown in Table 1.

(Preparation of Sample (Inventive) 12)

Coating solution 16 was coated on the support used in Comparative sample 1 by an air knife coater to obtain a first layer with a dry coating amount of 15 g/m$^2$, and dried. Further, coating solution 16 was coated on the resulting first layer by an air knife coater to give a second layer with a dry coating amount of 5 g/m$^2$, and dried. Thus, Sample 12 was prepared.

(Preparation of Sample (Inventive) 13)

Coating solution 18 was coated on the support used in Comparative sample 1 by an air knife coater to obtain a first layer with a dry coating amount of 12 g/m$^2$, and dried. Further, coating solution 8 was coated on the resulting first layer by an air knife coater to give a second layer with a wet thickness of 50 μm, and dried in the same manner as in Comparative sample 1. Thus, Sample 13 was prepared.

(Preparation of Sample (Inventive) 14)

Sample 14 was prepared in the same manner as in Sample 13, except that coating solution 19 was used as a coating solution for a first layer to obtain a first layer with a dry coating amount of 10 g/m$^2$, instead of coating solution 18.

(Preparation of Sample (Inventive) 15)

Sample 15 was prepared in the same manner as in Sample 3, except that a water absorptive paper support (a center stock for coat paper with a thickness of 165 μm) was used as a support.

(Preparation of Sample (Inventive) 16)

Sample 16 was prepared in the same manner as in Sample 3, except that a white polyethylene terephthalate film (with a thickness of 100 μm) was used as the substrate.

(Preparation of Samples (Inventive) 17 through 25)

Samples 17 through 25 were prepared by coating on RC paper the first, second, third, and fourth layers as shown in Table 1 in that order.

TABLE 1

| Recording medium sample No. | kinds of support | First layer CS. No. | First layer Wet thickness | Second layer CS. No. | Second layer Wet thickness | Third layer CS. No. | Third layer Wet thickness | Fourth layer CS. No. | Fourth layer Wet thickness | Fifth layer CS. No. | Fifth layer Wet thickness | Pigment content in upper layer (wt. %) |
|---|---|---|---|---|---|---|---|---|---|---|---|---|
| C.S. 1 | RC paper | 1 | 50 (μm) | 2 | 100 (μm) | 3 | 50 (μm) | — | — | — | — | |
| C.S. 2 | RC paper | 4 | 65 (μm) | 4 | 65 (μm) | 4 | 65 (μm) | 4 | 65 (μm) | — | — | |
| C.S. 3 | RC paper | 4 | 65 (μm) | 4 | 65 (μm) | 4 | 65 (μm) | 4 | 65 (μm) | L1 | (5 g/m$^2$) | |
| C.S. 4 | RC paper | 4 | 65 (μm) | 4 | 65 (μm) | 4 | 65 (μm) | 4 | 65 (μm) | L2 | (5 g/m$^2$) | |
| C.S. 5 | RC paper | 4 | 65 (μm) | 4 | 65 (μm) | 4 | 65 (μm) | 5 | 50 (μm) | — | — | 27 |
| S. 1 | RC paper | 4 | 65 (μm) | 4 | 65 (μm) | 4 | 65 (μm) | 6 | 50 (μm) | — | — | 46 |
| S. 2 | RC paper | 4 | 65 (μm) | 4 | 65 (μm) | 4 | 65 (μm) | 7 | 50 (μm) | — | — | 49 |
| S. 3 | RC paper | 4 | 65 (μm) | 4 | 65 (μm) | 4 | 65 (μm) | 8 | 50 (μm) | — | — | 55 |
| S. 4 | RC paper | 4 | 65 (μm) | 4 | 65 (μm) | 4 | 65 (μm) | 9 | 50 (μm) | — | — | 62 |
| S. 5 | RC paper | 4 | 65 (μm) | 4 | 65 (μm) | 4 | 65 (μm) | 10 | 50 (μm) | — | — | 67 |
| S. 6 | RC paper | 4 | 65 (μm) | 4 | 65 (μm) | 4 | 65 (μm) | 11 | 50 (μm) | — | — | 55 |
| S. 7 | RC paper | 4 | 65 (μm) | 4 | 65 (μm) | 4 | 65 (μm) | 12 | 50 (μm) | — | — | 55 |
| S. 8 | RC paper | 4 | 65 (μm) | 4 | 65 (μm) | 4 | 65 (μm) | 13 | 50 (μm) | — | — | 55 |

TABLE 1-continued

| Recording medium sample No. | kinds of support | First layer CS. No. | First layer Wet thickness | Second layer CS. No. | Second layer Wet thickness | Third layer CS. No. | Third layer Wet thickness | Fourth layer CS. No. | Fourth layer Wet thickness | Fifth layer CS. No. | Fifth layer Wet thickness | Pigment content in upper layer (wt. %) |
|---|---|---|---|---|---|---|---|---|---|---|---|---|
| S. 9 | RC paper | 4 | 65 (μm) | 4 | 65 (μm) | 4 | 65 (μm) | 14 | 50 (μm) | — | — | 55 |
| S. 10 | RC paper | 15 | 65 (μm) | 15 | 65 (μm) | 15 | 65 (μm) | 8 | 50 (μm) | — | — | 55 |
| S. 11 | RC paper | 1 | 50 (μm) | 2 | 100 (μm) | 3 | 50 (μm) | 8 | 50 (μm) | — | — | 55 |
| S. 12 | RC paper | 16 | (15 g/m$^2$) | 17 | (5 g/m$^2$) | — | — | — | — | — | — | 58 |
| S. 13 | RC paper | 18 | (12 g/m$^2$) | 8 | 50 (μm) | — | — | — | — | — | — | 55 |
| S. 14 | RC paper | 19 | (10 g/m$^2$) | 8 | 50 (μm) | — | — | — | — | — | — | 55 |
| S. 15 | Paper support | 4 | 65 (μm) | 4 | 65 (μm) | 4 | 65 (μm) | 8 | 50 (μm) | — | — | 55 |
| S. 16 | White PET | 4 | 65 (μm) | 4 | 65 (μm) | 4 | 65 (μm) | 8 | 50 (μm) | — | — | 55 |
| S. 17 | RC paper | 4 | 60 (μm) | 4 | 100 (μm) | 4 | 65 (μm) | 20 | 40 | — | — | 42 |
| S. 18 | RC paper | 4 | 65 (μm) | 4 | 65 (μm) | 4 | 65 (μm) | 21 | 35 | — | — | 35 |
| S. 19 | RC paper | 4 | 65 (μm) | 4 | 65 (μm) | 4 | 65 (μm) | 22 | 30 | — | — | 31 |
| S. 20 | RC paper | 4 | 65 (μm) | 4 | 65 (μm) | 4 | 65 (μm) | 23 | 40 | — | — | 42 |
| S. 21 | RC paper | 4 | 65 (μm) | 4 | 65 (μm) | 4 | 65 (μm) | 24 | 40 | — | — | 42 |
| S. 22 | RC paper | 4 | 65 (μm) | 4 | 65 (μm) | 4 | 65 (μm) | 25 | 40 | — | — | 42 |
| S. 23 | RC paper | 6 | 55 (μm) | 6 | 55 (μm) | 6 | 55 (μm) | 6 | 55 | — | — | 46 |
| S. 24 | RC paper | 24 | 45 (μm) | 24 | 45 (μm) | 24 | 45 (μm) | 24 | 45 | — | — | 42 |
| S. 25 | RC paper | 21 | 50 (μm) | 21 | 50 (μm) | 21 | 50 (μm) | 21 | 50 | — | — | 35 |

C.S.: "C.S." means "Comparative sample".
S.: "S." means "Sample".
CS.: "CS." means "Coating Solution".

In column "Wet thickness" in Table 1, a numerical value shown in the parenthesis represents a dry coating amount or a solid weight (g/m$^2$).

Preparation of Ink

Aqueous pigment ink was prepared according to the following procedures.

(Preparation of Yellow Pigment Dispersion 1)

| | |
|---|---|
| C.I. Pigment Yellow 74 | 20% by weight |
| Styrene-acrylic acid copolymer (having a molecular weight of 10,000 and an acid value of 120) | 12% by weight |
| Diethylene glycol | 15% by weight |
| Deionized water | 53% by weight |

The above components were mixed and dispersed employing a lateral type bead mill (System Zeta Mini, manufactured by Ashizawa Co., Ltd.) which was filled with zirconia beads at a volume ratio of 60 percent. Thus, Yellow pigment dispersion 1 was obtained. The average particle size of the yellow pigment in the dispersion obtained above was 112 nm.

(Preparation of Magenta Pigment Dispersion 1)

| | |
|---|---|
| C.I. Pigment Red 122 | 25% by weight |
| Joncryl 61 (Acryl-styrene resin, produced by Johnson Co., Ltd.), in terms of solid | 18% by weight |
| Diethylene glycol | 15% by weight |
| Deionized water | 42% by weight |

The above components were mixed and dispersed employing a lateral type bead mill (System Zeta Mini, manufactured by Ashizawa Co., Ltd.) which was filled with zirconia beads at a volume ratio of 60 percent. Thus, magenta pigment dispersion 1 was obtained. The average particle size of the magenta pigment in the dispersion obtained above was 105 nm.

(Preparation of Cyan Pigment Dispersion 1)

| | |
|---|---|
| C.I. Pigment Blue 15:3 | 25% by weight |
| Joncryl 61 (Acryl-styrene resin, produced by Johnson Co., Ltd.), in terms of solid | 15% by weight |
| Glycerin | 10% by weight |
| Deionized water | 50% by weight |

The above components were mixed and dispersed employing a lateral type bead mill (System Zeta Mini, manufactured by Ashizawa Co., Ltd.) which was filled with zirconia beads at a volume ratio of 60 percent. Thus, cyan pigment dispersion 1 was obtained. The average particle size of the cyan pigment in the dispersion obtained above was 87 nm.

(Preparation of Black Pigment Dispersion 1)

| | |
|---|---|
| Carbon Black | 20% by weight |
| Styrene-acrylic acid copolymer (having a molecular weight of 7,000 and an acid value of 150) | 10% by weight |
| Glycerin | 10% by weight |
| Deionized water | 60% by weight |

The above components were mixed and dispersed employing a lateral type bead mill (System Zeta Mini, manufactured by Ashizawa Co., Ltd.) which was filled with zirconia beads at a volume ratio of 60 percent. Thus, black pigment dispersion 1 was obtained. The average particle size of the black pigment in the dispersion obtained above was 75 nm.

Preparation of Pigment Ink (Preparation of Deep Yellow Ink 1)

| | |
|---|---|
| Yellow pigment dispersion 1 | 15% by weight |
| Acryl emulsion Yodosol AD 53 (Tg: 80° C., average particle size: 80 nm, produced by Nippon NCS Co., Ltd.) | 10% by weight |
| Ethylene glycol | 20% by weight |
| Diethylene glycol | 10% by weight |
| Maltitol | 5% by weight |
| Surfactant Surfinol 465 (produced by Nissin Chemical Industry Co., Ltd.) | 0.1% by weight |
| Deionized water | 39.9% by weight |

The above components were mixed with stirring, and filtered with a 1 μm filter. Thus, Deep yellow ink 1 was prepared. The surface tension of Deep yellow ink 1 was 36 mN/m, and the average particle size of the pigment particles contained in Deep yellow ink 1 was 120 nm.

(Preparation of Light Yellow Ink 1)

| | |
|---|---|
| Yellow pigment dispersion 1 | 3% by weight |
| Acryl emulsion Yodosol AD 53 (Tg: 80° C., average particle size: 80 nm, produced by Nippon NCS Co., Ltd.) | 10% by weight |
| Ethylene glycol | 25% by weight |
| Diethylene glycol | 10% by weight |
| Maltitol | 10% by weight |
| Surfactant Surfinol 465 (produced by Nissin Chemical Industry Co., Ltd.) | 0.1% by weight |
| Deionized water | 41.9% by weight |

The above components were mixed with stirring, and filtered with a 1 μm filter. Thus, Light yellow ink 1 was prepared. The surface tension of Light yellow ink 1 was 37 mN/m, and the average particle size of the pigment particles contained in Light yellow ink 1 was 118 nm.

(Preparation of Deep Magenta Ink 1)

| | |
|---|---|
| Magenta pigment dispersion 1 | 15% by weight |
| Styrene-acryl emulsion Microgel E-1002 (Tg: about 60° C., average particle size: 100 nm, produced by Nippon Paint Co., Ltd.) | 10% by weight |
| Ethylene glycol | 20% by weight |
| Diethylene glycol | 10% by weight |
| Maltitol | 5% by weight |
| Surfactant Surfinol 465 (produced by Nissin Chemical Industry Co., Ltd.) | 0.1% by weight |
| Deionized water | 39.9% by weight |

The above components were mixed with stirring, and filtered with a 1 μm filter. Thus, Deep magenta ink 1 was prepared. The surface tension of Deep magenta ink 1 was 35 mN/m, and the average particle size of the pigment particles contained in Deep magenta ink 1 was 113 nm.

(Preparation of Light Magenta Ink 1)

| | |
|---|---|
| Magenta pigment dispersion 1 | 3% by weight |
| Styrene-acryl emulsion Microgel E-1002 (Tg: about 60° C., average particle size: 100 nm, produced by Nippon Paint Co., Ltd.) | 8% by weight |
| Ethylene glycol | 25% by weight |

-continued

| | |
|---|---|
| Diethylene glycol | 10% by weight |
| Maltitol | 10% by weight |
| Surfactant Surfinol 465 (produced by Nissin Chemical Industry Co., Ltd.) | 0.1% by weight |
| Deionized water | 43.9% by weight |

The above components were mixed with stirring, and filtered with a 1 μm filter. Thus, Light magenta ink 1 was prepared. The surface tension of Light magenta ink 1 was 37 mN/m, and the average particle size of the pigment particles contained in Light yellow ink 1 was 110 nm.

(Preparation of Deep Cyan Ink 1)

Cyan Pigment Dispersion 1 10% by Weight

| | |
|---|---|
| Styrene-acryl emulsion Yodosol GD86B (Tg: 60° C., average particle size: 90 nm, produced by Nippon NCS Co., Ltd.) | 10% by weight |
| Ethylene glycol | 20% by weight |
| Diethylene glycol | 10% by weight |
| Maltitol | 5% by weight |
| Surfactant Surfinol 465 (produced by Nissin Chemical Industry Co., Ltd.) | 0.1% by weight |
| Deionized water | 44.9% by weight |

The above components were mixed with stirring, and filtered with a 1 μm filter. Thus, Deep cyan ink 1 was prepared. The surface tension of Deep cyan ink 1 was 36 mN/m, and the average particle size of the pigment particles contained in Deep cyan ink 1 was 95 nm.

(Preparation of Light Cyan Ink 1)

| | |
|---|---|
| Cyan pigment dispersion 1 | 2% by weight |
| Acryl emulsion Yodosol GD86B (Tg: 60° C., average particle size: 90 nm, produced by Nippon NCS Co., Ltd.) | 10% by weight |
| Ethylene glycol | 25% by weight |
| Diethylene glycol | 10% by weight |
| Maltitol | 10% by weight |
| Surfactant Surfinol 465 (produced by Nissin Chemical Industry Co., Ltd.) | 0.2% by weight |
| Deionized water | 42.8% by weight |

The above components were mixed with stirring, and filtered with a 1 μm filter. Thus, Light cyan ink 1 was prepared. The surface tension of Light cyan ink 1 was 33 mN/m, and the average particle size of the pigment particles contained in Light cyan ink 1 was 92 nm.

(Preparation of Deep Black Ink 1)

| | |
|---|---|
| Black pigment dispersion 1 | 10% by weight |
| Acryl emulsion Yodosol GD86B (Tg: 60° C., average particle size: 90 nm, produced by Nippon NCS Co., Ltd.) | 8% by weight |
| Ethylene glycol | 20% by weight |
| Diethylene glycol | 10% by weight |
| Maltitol | 5% by weight |
| Surfactant Surfinol 465 (produced by Nissin Chemical Industry Co., Ltd.) | 0.1% by weight |
| Deionized water | 46.9% by weight |

The above components were mixed with stirring, and filtered with a 1 μm filter. Thus, Deep black ink 1 was prepared. The surface tension of Deep black ink 1 was 35 mN/m, and the average particle size of the pigment particles contained in Deep black ink 1 was 85 nm.

(Preparation of Light Black Ink 1)

| | |
|---|---|
| Black pigment dispersion 1 | 2% by weight |
| Acryl emulsion Yodosol GD86B (Tg: 60° C., average particle size: 90 nm, produced by Nippon NCS Co., Ltd.) | 8% by weight |
| Ethylene glycol | 25% by weight |
| Diethylene glycol | 10% by weight |
| Maltitol | 10% by weight |
| Surfactant Surfinol 465 (produced by Nissin Chemical Industry Co., Ltd.) | 0.1% by weight |
| Deionized water | 44.9% by weight |

The above components were mixed with stirring, and filtered with a 1 μm filter. Thus, Light black ink 1 was prepared. The surface tension of Light black ink 1 was 36 mN/m, and the average particle size of the pigment particles contained in Light black ink 1 was 89 nm.

Ink Jet Image

Ink jet images 1 through 42 were formed under post-treatment conditions as shown in Table 2, employing the ink and recording media as shown in Table 2.

The dye inks in Table 2 were those exclusively installed in an ink jet printer PM-770 (produced by Seiko-Epson Co., Ltd.). Images 1 and 2 were formed employing ink jet printer PM-770. Images formed employing ink jet printer PM-770 were subjected to heating treatment employing heating system 4 as shown in FIG. 1 described later to obtain images 3 through 23 shown in Table 2. Images 22 and 23 were formed employing an ink jet printer MC-2000 (produced by Seiko-Epson Co., Ltd.). Further, images were formed employing a printer in FIG. 1 described later, which was installed with the pigment inks prepared above, and were subjected to heating treatment employing heating system 4 as shown in FIG. 1 to obtain images 24 through 42 shown in Table 2. A test chart having a 1 cm wide band of each of Y, M, C, B, G, R and Bk, both in the longitudinal direction and in the lateral direction, were ink jet recorded to form an ink jet image.

FIG. 1 shows a schematic view of an ink jet recording apparatus employing the pigment ink used in the Example.

In the ink jet recording apparatus of FIG. 1, 8 pigment inks (deep yellow, magenta, cyan and black pigment inks, and light yellow, magenta, cyan and black pigment inks) were placed in the corresponding recording heads 3, and a recording medium 1 with a width of 12.7 cm in a roll form was set into position. The recording medium 1 was transported through transport rollers 2, and images including yellow, magenta, cyan and black wedge images were continuously printed on the recording medium. The resulting recording medium was cut by a built-in cutter 6 every 8.9 cm, after printing. Thus, prints with a size of 12.7×8.9 $cm^2$ were continuously prepared through a pair of transport rollers 71 and 721. Some prints were heated employing a built-in heating system 4. In FIG. 1, a numerical number 41 shows a heating roller, a numerical number 42 a pressure roller, a numerical number 43 a heater, and a numerical number 5 a temperature sensor.

Image forming speed was adjusted by changing the number of recording head nozzles, the recording head scanning speed, the ink jetting frequency, the transport speed of recording medium or the fixing roller, fixing conditions, or the width of the recording medium.

Images except for image Nos. 1, 2, 22 and 23 were subjected to heat treatment employing a heated roller, whereby thermoplastic particles in the uppermost layer were melted.

Evaluation of Ink Jet Images

Images 1 through 42 were evaluated according to the following evaluation criteria.

(Visual Evaluation of the Images)

The test chart image and portrait image were visually evaluated by 20 arbitrarily selected inspectors. The evaluation was carried out compared with photographic test chart image and photographic portrait image, which were printed on conventional photographic color paper Color Paper Type QAA7 (gloss type) produced by Konica Corporation. The number of inspectors judging the ink jet image as the same quality as the photographic image was counted. The evaluation was carried out according to the following criteria.

5: Not less than seventeen inspectors judged the ink jet image to be the same quality as the photographic image.
4: Fourteen to sixteen inspectors judged the ink jet image to be the same quality as the photographic image.
3: Ten to thirteen inspectors judged the ink jet image to be the same quality as the photographic image.
2: Six to nine inspectors judged the ink jet image to be the same quality as the photographic image.
1: Less than six inspectors judged the ink jet image to be the same quality as the photographic image.

(Evaluation of Bleed)

Bleed, which relates to ink absorption speed, was evaluated. In the band image of each of Y, M, C, B, G, R, Bk colors, the boundary between the image and white background was visually observed, and bleed was evaluated according to the following criteria.

4: No bleed was observed at the boundary of any of the color images.
3: Slight bleed was observed at the boundary of a few color images.
2: Some bleed was observed at the boundary of several color images.
1: Marked bleed was observed at the boundary of several color images.

(Evaluation of Bleed)

Regarding samples 22 through 42, bronzing, a phenomenon specific to pigment ink, was evaluated according to the following criteria.

Under a fluorescent lamp, each image placed on a horizontal surface was observed at various angles, namely, 80°, 60°, 45°, and 30°, (the direction perpendicular to the image was 90°, and the horizontal surface direction was 0°). An image, which was recognized to have metallic glossiness, was rated as 1, and an image, which was not recognized to have metallic glossiness, was rated as 2.

(Evaluation of Image Surface Strength)

The surface strength of the ink jet images was measured according to JIS K6717. Measurement was carried out at 23° C. and 55% RH employing a continuous weighting scratch meter HEIDON TYPE 18 (produced by Shinto Kagaku Co., Ltd.). Scratch test was carried out at a scratching distance of 100 mm, varying the weight from 0 to 100 g and employing a scratching needle (a sapphire needle) with a point diameter of 0.05 μm. The scratch weight at which the surface image was scratched was noted. A scratch weight less than 50 g was rated as B, and a scratch weight not less than 50 g was rated as A.

(Evaluation of Abrasion Resistance)

Images printed in pigment ink are generally poor in abrasion resistance, since pigment particles are located on the image surface. Therefore, pigment ink images were evaluated for abrasion resistance. The images were rubbed 5 times employing a Kimwipe S-200 (produced by Kuresia Co., Ltd.), and the degree of decrease in density was rated based on the criteria described below.

A: No decrease in density was observed.

B: A slight decrease in density was observed, but image quality was not problematic.

C: A decrease in density was observed, and image quality was degraded.

D: Marked decrease in density was observed, resulting in highly adverse effects on image quality.

(Evaluation 1 of Image Storage Stability: Light Fastness)

An optical wedge image of each of yellow, magenta, cyan, and black having a density of 1.0 was irradiated employing a xenon fadometer at a 70000 Lx for 240 hours, and the residual reflection density rate of each wedge image was determined by the formula:

Residual reflection density rate (%)=(Reflection density after xenon fadometer irradiation/Reflection density before xenon fadometer irradiation)×100

As a result, the residual reflection density of the magenta wedge image was lowest. Therefore, the magenta wedge image was evaluated according to the following criteria:

5: Residual reflection density rate was not less than 95%.

4: Residual reflection density rate was from 85% to less than 95%.

3: Residual reflection density rate was from 70% to less than 85%.

2: Residual reflection density rate was from 50% to less than 70%.

1: Residual reflection density rate was less than 50%.

(Evaluation 2 of Image Storage Stability: Water Resistance)

Evaluation of water resistance was carried out on images printed on samples 1 to 21 in magenta dye ink. The samples with the resulting magenta images were immersed in 25° C. pure water for 1 minute, and dried. The ratio (by percentage) of image reflection density of sample after immersion to image reflection density of sample before immersion was determined as residual reflection density rate (%) of the image. The residual reflection density ratio was determined by the following formula, and water resistance was evaluated according to the criteria described below.

The reflection density was measured, employing a densitometer 938 Spectrodensitometer produced by X-Rite Co., Ltd.

Residual reflection density rate (%)=(Magenta image reflection density of sample after immersion)/Magenta image reflection density of sample before immersion)×100

5: Residual reflection density rate not more than 95%

4: Residual reflection density rate from 85% to less than 95%

3: Residual reflection density rate from 70% to less than 85%

2: Residual reflection density rate from 50% to less than 70%

1: Residual reflection density rate less than 50%

The greater the residual reflection density rate is, the higher the water resistance.

(Evaluation of Adhesion Resistance During Ink Jet Image Storage)

Samples with images formed as described above were placed in a commercially available album with a protective sheet, and stored at 50° C. and 80% RH for 2 months. Thereafter, the protective sheet was peeled and the degree of peeling of the image was visually observed.

The results are shown in Table 2.

TABLE 2

| | Recording | | | Evaluation of image (ranking) | | | | Image storage stability (ranking) | | |
|---|---|---|---|---|---|---|---|---|---|---|
| Image No. | medium sample No. | Kinds of ink | Post-treatment | Image quality | Bleed | Bronzing | Image surface strength | Light fastness | Water resistance | Abrasion resistance |
| 1 | C.S. 1 | Dye | None | 5 | 4 | — | A | 1 | 3 | — |
| 2 | C.S. 2 | Dye | None | 5 | 4 | — | A | 1 | 3 | — |
| 3 | C.S. 3 | Dye | Heating | 4 | 2 | — | B | 3 | 5 | — |
| 4 | C.S. 4 | Dye | Heating | 4 | 2 | — | B | 3 | 5 | — |
| 5 | C.S. 5 | Dye | Heating | 4 | 2 | — | B | 3 | 5 | — |
| 6 | S. 1 | Dye | Heating | 5 | 4 | — | A | 3 | 5 | — |
| 7 | S. 2 | Dye | Heating | 5 | 4 | — | A | 3 | 5 | — |
| 8 | S. 3 | Dye | Heating | 5 | 4 | — | A | 3 | 5 | — |
| 9 | S. 4 | Dye | Heating | 5 | 4 | — | A | 3 | 5 | — |
| 10 | S. 5 | Dye | Heating | 5 | 4 | — | A | 3 | 5 | — |
| 11 | S. 6 | Dye | Heating | 5 | 4 | — | A | 3 | 5 | — |
| 12 | S. 7 | Dye | Heating | 5 | 4 | — | A | 3 | 5 | — |
| 13 | S. 8 | Dye | Heating | 5 | 4 | — | A | 3 | 5 | — |
| 14 | S. 9 | Dye | Heating | 5 | 4 | — | A | 3 | 5 | — |
| 15 | S. 10 | Dye | Heating | 5 | 4 | — | A | 3 | 5 | — |
| 16 | S. 11 | Dye | Heating | 5 | 4 | — | A | 3 | 5 | — |
| 17 | S. 12 | Dye | Heating | 5 | 4 | — | A | 3 | 5 | — |
| 18 | S. 13 | Dye | Heating | 5 | 3 | — | A | 3 | 5 | — |
| 19 | S. 14 | Dye | Heating | 5 | 3 | — | A | 3 | 5 | — |
| 20 | S. 15 | Dye | Heating | 5 | 4 | — | A | 3 | 5 | — |
| 21 | S. 16 | Dye | Heating | 5 | 4 | — | A | 3 | 5 | — |
| 22 | C.S. 1 | Pig. | None | 2 | 4 | 1 | A | 3 | — | D |
| 23 | C.S. 2 | Pig. | None | 2 | 4 | 1 | A | 3 | — | D |
| 24 | C.S. 3 | Pig. | Heating | 4 | 2 | 2 | B | 4 | — | B |

TABLE 2-continued

| Image No. | Recording medium sample No. | Kinds of ink | Post-treatment | Evaluation of image (ranking) | | | | Image storage stability (ranking) | | |
|---|---|---|---|---|---|---|---|---|---|---|
| | | | | Image quality | Bleed | Bronzing | Image surface strength | Light fastness | Water resistance | Abrasion resistance |
| 25 | C.S. 4 | Pig. | Heating | 4 | 2 | 2 | B | 4 | — | B |
| 26 | C.S. 5 | Pig. | Heating | 4 | 2 | 2 | B | 4 | — | B |
| 27 | S. 1 | Pig. | Heating | 5 | 4 | 2 | A | 5 | — | A |
| 28 | S. 2 | Pig. | Heating | 5 | 4 | 2 | A | 5 | — | A |
| 29 | S. 3 | Pig. | Heating | 5 | 4 | 2 | A | 5 | — | A |
| 30 | S. 4 | Pig. | Heating | 5 | 4 | 2 | A | 5 | — | A |
| 31 | S. 5 | Pig. | Heating | 5 | 4 | 2 | A | 5 | — | A |
| 32 | S. 6 | Pig. | Heating | 5 | 4 | 2 | A | 5 | — | A |
| 33 | S. 7 | Pig. | Heating | 5 | 4 | 2 | A | 5 | — | A |
| 34 | S. 8 | Pig. | Heating | 5 | 4 | 2 | A | 5 | — | A |
| 35 | S. 9 | Pig. | Heating | 5 | 4 | 2 | A | 5 | — | A |
| 36 | S. 10 | Pig. | Heating | 5 | 4 | 2 | A | 5 | — | A |
| 37 | S. 11 | Pig. | Heating | 5 | 4 | 2 | A | 5 | — | A |
| 38 | S. 12 | Pig. | Heating | 5 | 4 | 2 | A | 5 | — | A |
| 39 | S. 13 | Pig. | Heating | 4 | 3 | 2 | A | 5 | — | A |
| 40 | S. 14 | Pig. | Heating | 4 | 3 | 2 | A | 5 | — | A |
| 41 | S. 15 | Pig. | Heating | 5 | 4 | 2 | A | 5 | — | A |
| 42 | S. 16 | Pig. | Heating | 5 | 4 | 2 | A | 5 | — | A |
| 43 | S. 17 | Dye | Heating | 5 | 4 | — | A | 3 | 5 | — |
| 44 | S. 18 | Dye | Heating | 5 | 4 | — | A | 3 | 5 | — |
| 45 | S. 19 | Dye | Heating | 5 | 4 | — | A | 3 | 5 | — |
| 46 | S. 20 | Dye | Heating | 5 | 4 | — | A | 3 | 5 | — |
| 47 | S. 21 | Dye | Heating | 5 | 4 | — | A | 3 | 5 | — |
| 48 | S. 22 | Dye | Heating | 5 | 4 | — | A | 3 | 5 | — |
| 49 | S. 17 | Pig. | Heating | 5 | 4 | 2 | A | 5 | — | A |
| 50 | S. 18 | Pig. | Heating | 5 | 4 | 2 | A | 5 | — | A |
| 51 | S. 19 | Pig. | Heating | 5 | 4 | 2 | A | 5 | — | A |
| 52 | S. 20 | Pig. | Heating | 5 | 4 | 2 | A | 5 | — | A |
| 53 | S. 21 | Pig. | Heating | 5 | 4 | 2 | A | 5 | — | A |
| 54 | S. 22 | Pig. | Heating | 5 | 4 | 2 | A | 5 | — | A |
| 55 | S. 23 | Dye | Heating | 5 | 3 | — | A | 3 | 5 | — |
| 56 | S. 24 | Dye | Heating | 5 | 3 | — | A | 3 | 5 | — |
| 57 | S. 25 | Dye | Heating | 5 | 3 | — | A | 3 | 5 | — |
| 58 | S. 23 | Pig. | Heating | 5 | 3 | 2 | A | 5 | — | A |
| 59 | S. 24 | Pig. | Heating | 5 | 3 | 2 | A | 5 | — | A |
| 60 | S. 25 | Pig. | Heating | 5 | 3 | 2 | A | 5 | — | A |

C.S.: "C.S." means "Comparative sample".
S.: "S." means "Sample".

As is apparent from Table 2, in image Nos. 1 to 21 printed employing dye ink, image Nos. 3 to 5, which were printed on Comparative samples 3 to 5, respectively, provided poor image quality as compared with photographic images, and produced color bleed. This is considered to be due to low ink absorption of Comparative samples 3 to 5. Image Nos. 3 to 5 also exhibited lowered image surface strength. Image Nos. 1 and 2 which were printed on comparative samples comprising an uppermost layer containing no thermoplastic particles, were excellent in bleed, but exhibited poor water resistance, and extremely poor light fastness. In the images printed employing pigment ink, image Nos. 22 and 23, which were printed on comparative samples comprising an uppermost layer containing no thermoplastic particles and were not subjected to heat treatment, lacked transparency and glossiness, provided poor image quality as compared with photographic images, exhibited bronzing specific to pigment ink, and further had the disadvantages that exact images could not be viewed depending on viewing angles. Images Nos. 24 to 26, which were subjected to heat treatment, produced color bleed, resulting in unsatisfactory ones. In contrast, images Nos. 6 through 21, and 27 through 42, which were printed on inventive samples and subjected to heat treatment, provided images identical to silver halide photographic images, minimized bleed, provided improved abrasion resistance and improved image surface strength. Further, water resistance, which is a problem specific to dye ink, was improved, and bronzing, which is a problem specific to pigment ink, was also improved. Inventive samples exhibited good results on all the tested items. Light fastness of dye ink images on inventive samples were improved as compared with dye ink images on comparative samples, although the improvement degree was not sufficiently high. However, light fastness of pigment ink images on inventive samples provided extremely excellent results.

Writability on each sample with formed images was evaluated. An image was written on the white background (non-image portions) of the sample with an aqueous ink pen, an oily ink ball point pen, or a fountain pen, and ink receptivity was evaluated. Further, in order to evaluate durability of character images, character images were rubbed one time back and forth with Kimwipe S-200 (produced by Kresia Co., Ltd.). As a result, image Nos. 3 to 5, and image Nos. 24 to 26 were difficult to receive any ink of the above writing instruments, and were blurred, and if rubbed, further image blurring was caused. In contrast, images on the inventive samples provided excellent writability.

Image 41, which was printed on sample 15 employing MC 2000 was sprayed with ethyl acetate, and dried by passing between a pair of pressure rollers. The resulting image exhibited improved glossiness equal to heat-treated images, and the desired effects of the invention providing improved image quality and image storage stability were confirmed.

Regarding adhesion resistance after the image storage, which was not shown in Table 2, the protective sheet could be easily peeled without causing image defects, after accelerated storage test in the album. Images 3 to 5, and images 24 to 26, when the protective sheet was peeled, was adhered to the surface of the sheet, and the image surface was partly peeled, resulting in image damage.

Example 2

Ink jet printing was carried out employing samples 1 through 16 (Inventive) and pigment ink, in which high speed printing and post-treatment which followed were carried out, employing an ink jet recording apparatus shown in FIG. 1.

When the amount printed per hour was from 100 recording sheets (corresponding to 1.13 $m^2$) each measuring 12.7×8.9 $cm^2$ to 1300 recording sheets (corresponding to 14.69 $m^2$) each measuring 12.7×8.9 $cm^2$, good prints were obtained. When the amount printed per hour was not less than 1400 of the recording sheet, there occurred recording sheet transport defects or image defects in that melted thermoplastic particles adhered to heated rollers for fixing. The reason why the defects occurred is not clear. The reason is probably because as the printed amount increases, recording sheets curl due to water vapor generated during heating, resulting in transport defects. Further, the increase in printed amount requires heat necessary to fix in short time, and therefore, more elevated temperature to be set. This high temperature treatment may relate to the image defects.

As is apparent from Example 1, in order to obtain prints from photographic prints employing ink jet recording, a method is extremely suitable in view of image quality and image storage stability, which comprises forming an image on a recording medium comprising an upper layer containing thermoplastic particles employing pigment ink, and then heating the thermoplastic particles to melt and form a film. Further, in has been found that the total image forming speed comprising ink jet recording speed and heating (fixing) speed requires at least 1 $m^2$/hour, and has an upper limit of 15 $m^2$/hour, in view of heating and fixing capability.

Ink jet printing was carried out employing comparative sample S. Image defects due to transport rollers occurred. Particularly when the amount printed per hour exceeded 200 recording sheets each measuring 12.7×8.9 $cm^2$, there markedly occurred recording sheet transport defects or image defects in that melted thermoplastic particles adhered to heated rollers for fixing. Superiority of the invention in high speed printing was confirmed.

EFFECTS OF THE INVENTION

The present invention can provide an ink jet recording medium, in which an image with high quality equal to that of a silver halide photographic image can be printed at a high speed, color bleed and bronzing are minimized, the image surface strength and writability are improved, and light fastness, water resistance, abrasion resistance and adhesion resistance after storage in an album are enhanced, its manufacturing method, an image forming method employing the ink jet recording medium, and an image formed according to the image forming method.

What is claimed is:

1. An ink jet recording medium comprising a substrate and a plurality of ink absorption layers provided thereon, wherein the uppermost layer of the ink absorption layers contains inorganic pigment, a binder and thermoplastic particles having a glass transition point of 78 to 150° C., and the content by weight of the inorganic pigment being greater than that of the thermoplastic particles.

2. The ink jet recording medium of claim 1, wherein at least one of the plural ink absorption layers other than the uppermost layer contains inorganic pigment.

3. The ink jet recording medium of claim 2, wherein the inorganic pigment is silica.

4. The ink jet recording medium of claim 2, wherein the inorganic pigment is alumina.

5. The ink jet recording medium of claim 2, wherein at least one of the plural ink absorption layers other than the uppermost layer contains inorganic pigment in an amount of not less than 50% by weight.

6. The ink jet recording medium of claim 1, wherein the inorganic pigment is silica.

7. The ink jet recording medium of claim 1, wherein the inorganic pigment is alumina.

8. The ink jet recording medium of claim 1, wherein the content ratio by weight of thermoplastic particles/inorganic pigment is from 45/55 to 10/90.

9. The ink jet recording medium of claim 1, wherein the solid content of the thermoplastic particles contained in the uppermost layer is from 0.5 to 15 g/$m^2$ of the medium.

10. The ink jet recording medium of claim 1, wherein the solid content of the uppermost layer is from 2 to 50 g/$m^2$ of the medium.

11. A method of manufacturing the ink jet recording medium according to claim 1, wherein the method comprises the step of simultaneously coating the uppermost layer and the layer adjoining the uppermost layer on the substrate.

12. The method of claim 11, wherein all of the plural ink absorption layers are simultaneously multi-layer coated.

13. An ink jet recording medium of claim 1, wherein the substrate comprises a base paper laminated with polyethylene film on both sides.

14. An ink jet recording medium of claim 1, wherein the inorganic pigment is a gas phase method silica.

15. An ink jet recording medium of claim 1, wherein the inorganic pigment has an average primary particle size of from 4 to 50 nm.

16. An ink jet recording medium of claim 1, wherein the thermoplastic particles has an average particle size of from 0.1 to 5 μm.

17. An ink jet recording medium of claim 1, wherein the thermoplastic particles have a solid content of from 1 to 7 g/$m^2$.

18. An ink jet recording medium of claim 1, wherein the thermoplastic particles have a residual monomer content of not more than 1% by weight.

19. An ink jet recording medium of claim 1, wherein the binder is a polyvinyl alcohol.

* * * * *